US011756435B2

(12) United States Patent
Chen et al.

(10) Patent No.: US 11,756,435 B2
(45) Date of Patent: Sep. 12, 2023

(54) AIRSPACE NETWORK OPTIMIZATION METHOD BASED ON FLIGHT NORMALITY TARGET

(71) Applicant: THE 28TH RESEARCH INSTITUTE OF CHINA ELECTRONICS TECHNOLOGY GROUP CORPORATION, Nanjing (CN)

(72) Inventors: Feifei Chen, Nanjing (CN); Mingwei Zhang, Nanjing (CN); Hui Ding, Nanjing (CN); Ming Tong, Nanjing (CN); Xiaozhu Shi, Nanjing (CN); Shan'e Xu, Nanjing (CN); Jibo Huang, Nanjing (CN); Yang Zhang, Nanjing (CN); Fan Bao, Nanjing (CN); Ke Xu, Nanjing (CN); Jing Tian, Nanjing (CN); Wenyi Tang, Nanjing (CN); Zeyuan Liu, Nanjing (CN); Qingqing Tan, Nanjing (CN); Weiyu Jiang, Nanjing (CN)

(73) Assignee: THE 28TH RESEARCH INSTITUTE OF CHINA ELECTRONICS TECHNOLOGY GROUP CORPORATION, Nanjing (CN)

( * ) Notice: Subject to any disclaimer, the term of this patent is extended or adjusted under 35 U.S.C. 154(b) by 0 days.

(21) Appl. No.: 17/818,982

(22) Filed: Aug. 11, 2022

(65) Prior Publication Data

US 2022/0383759 A1 Dec. 1, 2022

Related U.S. Application Data

(63) Continuation of application No. PCT/CN2022/101840, filed on Jun. 28, 2022.

(30) Foreign Application Priority Data

Oct. 18, 2021 (CN) ..... 202111208587.1

(51) Int. Cl.
*G08G 5/00* (2006.01)

(52) U.S. Cl.
CPC ..... *G08G 5/0039* (2013.01)

(58) Field of Classification Search
CPC ..... G08G 5/0039
(Continued)

(56) References Cited

U.S. PATENT DOCUMENTS

2010/0106396 A1* 4/2010 Chang ..... G06Q 10/00 701/120
2016/0063868 A1* 3/2016 White ..... G08G 5/0039 701/120
2016/0093221 A1* 3/2016 Bailey ..... G08G 5/0013 701/120

FOREIGN PATENT DOCUMENTS

CN 105427672 A 3/2016
CN 107016881 A 8/2017
(Continued)

*Primary Examiner* — Peter D Nolan
*Assistant Examiner* — Luke Huynh
(74) *Attorney, Agent, or Firm* — CBM Patent Consulting, LLC

(57) ABSTRACT

An airspace network optimization method based on a flight normality target is capable of comprehensively considering spatial and temporal distribution of national air traffic demands, a service capability of an airspace network and a capacity increase limit of each airspace unit according to the flight normality optimization target on the basis of carrying out pre-analysis on a flight operation efficiency under a current airspace service capability, to position a key problem airspace and generate a capacity expansion suggestion of the related airspace; and aims at improving the flight operation efficiency by expanding the airspace service capability, and providing technical support for a user to carry out analysis and optimization work of national airspace network problems at a strategic level.

1 Claim, 7 Drawing Sheets

(58) Field of Classification Search
USPC ..... 701/120
See application file for complete search history.

(56) References Cited

FOREIGN PATENT DOCUMENTS

| | | | |
|---|---|---|---|
| CN | 109598984 | A | 4/2019 |
| CN | 11508280 | A | 8/2020 |
| CN | 113034980 | A | 6/2021 |
| WO | 2021122397 | A1 | 6/2021 |

* cited by examiner

AIRSPACE NETWORK OPTIMIZATION METHOD BASED ON FLIGHT NORMALITY TARGET

CROSS REFERENCES

This application is the U.S. continuation application of International Application No. PCT/CN2022/101840 filed on 28 Jun. 2022 which designated the U.S. and claims priority to Chinese Application No. CN202111208587.1 filed on 18 Oct. 2021, the entire contents of each of which are hereby incorporated by reference.

TECHNICAL FIELD

The present invention belongs to the field of civil aviation flow management, and more particularly, to an airspace network optimization method based on a flight normality target.

BACKGROUND

With the rapid development of civil aviation industry, the contradiction between limited airspace resources and increasing traffic demands has become increasingly prominent, resulting in the increasingly serious flight delays, which has reduced the economic benefits and passenger satisfaction of airlines. In order to cope with the problem of insufficient airspace supply, air traffic management departments in manage air traffic demand from the aspects of strategy, pre-tactics, tactics, or the like, with a view to reducing the flight delays as much as possible on the premise of ensuring the safety. However, these approaches cannot fundamentally solve the flight delays caused by insufficient airspace service capacities.

SUMMARY

Object of the present invention: the technical problem to be solved by the present invention is to provide an airspace network optimization method based on a flight normality target for the deficiencies of the prior art, comprising the following steps of:

- step 1: preparing basic data by acquiring required calculating data and performing preliminary processing on the data;
- step 2: analyzing flight operation efficiency according to an airspace service capability by filtering flights that cannot be executed normally according to the original flight plan, and analyzing the flight operation efficiency according to national airport and sector capacity limits;
- step 3: calculating a flight range that needs to be guaranteed by airspace expansion based on the flight normality target; and
- step 4: generating an airspace network optimization solution according to the flight that needs to be guaranteed, which is capable of locating a key problem airspace according to the flight that needs to be guaranteed, and providing a capacity optimization suggestion thereof.
- in the present invention, the adjustment of the national airspace network is executed according to the airspace network optimization solution obtained in the step 4.

The airspace network optimization method based on the flight normality target according to the present invention is loaded and operated in a processing server an air traffic flow management system (ATFM system) or a corresponding computer of an air traffic control system (ATC system).

The present invention has the beneficial effects that: the method of the present invention aims to improve the flight normality during operation and reduce the flight delay by expanding the airspace service capacity; and the method is capable of comprehensively considering spatial and temporal distribution of national air traffic demands, a service capability of an airspace network and a capacity increase limit of each airspace unit according to the flight normality optimization target to position a key problem airspace and generate a capacity expansion suggestion of the related airspace, and provide technical support for a user to carry out analysis and optimization work of national airspace network problems at a strategic level.

BRIEF DESCRIPTION OF THE DRAWINGS

The advantages of the above and/or other aspects of the present invention will become more apparent by further explaining the present invention with reference to the following drawings and detailed description.

DETAILED DESCRIPTION the present invention provides an airspace network optimization method based on a flight normality target.

The method of the present invention comprises the following steps of:

- step 1: preparing basic data by acquiring required calculating data and performing preliminary processing on the data;
- step 2: analyzing flight operation efficiency according to an airspace service capability by filtering flights that cannot be executed normally according to the original flight plan, and analyzing the flight operation efficiency according to national airport and sector capacity limits;
- step 3: calculating a flight range that needs to be guaranteed by airspace expansion based on the flight normality target; and
- step 4: generating an airspace network optimization solution according to the flight that needs to be guaranteed; expanding the airspace service capacity.

Figure 1:
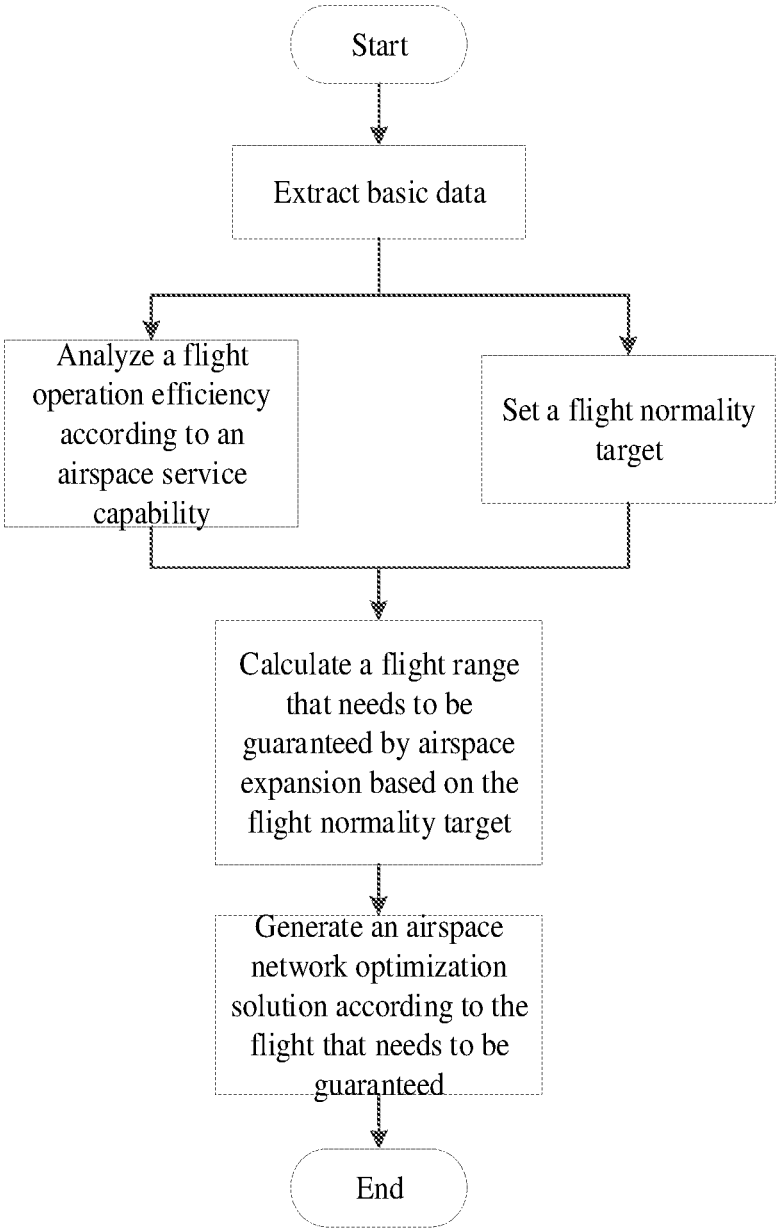
FIG. 1 is an overall processing flow chart of the present invention.

The overall processing flow is shown in FIG. 1.

The step 1 comprises:

- the function of this step is: to acquire the calculating data required by the method and perform preliminary processing on the data according to according to calculating needs.

The following steps are comprised:

step 1-1: defining variables;

step 1-2: acquiring the basic data; and step 1-3: processing the basic data.

The step 1-1 comprises: defining the following variables:

ANA_DATE: analysis date;

FltListIni: a national flight plan array, comprising all flight plans related to the analysis date ANA_DATE;

FltTotalNumIni: a total number of flight plans in the national flight plan array FltListIni;

$Flt_i$: an $i^{th}$ flight plan in the national flight plan array FltListIni;

$ACID_i$: a flight identity in the $i^{th}$ flight plan $Flt_i$;

$Flt_i$ (PRIO): a priority of the $i^{th}$ flight plan $Flt_i$, wherein the value is a non-negative integer with an initial value of 0, and may be set by the user as needed;

$DepApt_i$: a departure airport of the $i^{th}$ flight plan $Flt_i$;

$ArrApt_i$: an arrival airport of the $i^{th}$ flight plan $Flt_i$;

$ETD_i$: an estimated time of departure of the $i^{th}$ flight plan $Flt_i$;

$ETA_i$: an estimated time of arrival of the $i^{th}$ flight plan $Flt_i$;

$STD_i$: a sequenced time of departure of the $i^{th}$ flight plan $Flt_i$, with an initial value of ETD $STA_i$: a sequenced time of arrival of the $i^{th}$ flight plan $Flt_i$, with an initial value of $ETA_i$;

$DepDelay_i$: a sequenced departure delay of the $i^{th}$ flight plan $Flt_i$ in a unit of second;

$AdjMark_i$: a sequenced adjustment mode of the $i^{th}$ flight plan $Flt_i$, wherein 0 represents unadjustment, 1 represents time advance, 2 represents delay, 3 represents deletion, and an initial value is 0;

$PassSectorList_i$: a sector-passing array of the $i^{th}$ flight plan $Flt_i$, comprising information of all sectors passed by the $i^{th}$ flight plan $Flt_i$;

$PassSector_{i,j}$: information of a $j^{th}$ sector in the sector-passing array $PassSectorList_i$ of the $i^{th}$ flight plan $Flt_i$;

$PassSector_{i,j}$(Code): a code of the $j^{th}$ sector $PassSector_{i,j}$ in the sector-passing array $PassSectorList_i$ of the $i^{th}$ flight plan $Flt_i$;

$PassSector_{i,j}$(InETO): an estimated entry time of the $j^{th}$ sector $PassSector_{i,j}$ in the sector-passing array $PassSectorList_i$ of the $i^{th}$ flight plan $Flt_i$;

$PassSector_{i,j}$(InSTO): a sequenced entry time of the $j^{th}$ sector $PassSector_{i,j}$ in the sector-passing array $PassSectorList_i$ of the $i^{th}$ flight plan $Flt_i$;

APTLIST: an airport array, comprising information of all national airports;

AptTotalNum: a number of airports comprised in the airport array APTLIST;

$APT_i$: an $i^{th}$ airport in the airport array APTLIST;

$APT_i$(CODE): a four-character code of the airport $APT_i$;

SECTORLIST: a sector array, comprising information of all national sectors;

SectorTotalNum: a number of sectors comprised in the sector array SECTORLIST;

$SECTOR_i$: an $i^{th}$ sector in the sector array SECTORLIST;

$SECTOR_i$(CODE): a code of the sector:

[tBgnTime, tEndTime]: a computing time range of the method, wherein tBgnTime refers to 00:00:00 of the analysis date ANA_DATE, while tEndTime refers to 23:59:59 of the analysis date ANA_DATE;

CapSpanTime: a time slice span in the method, which has a default value of 3,600 seconds (i.e., 1 hour), and may be adjusted by the user as needed;

CapSpanNum: a number of time slices in the computing time range of the method, with an initial value of 0;

[$CapBgnTime_j$, $CapEndTime_j$): a $j^{th}$ time slice in the computing time range [tBgnTime, tEndTime], wherein $CapBgnTime_j$ refers to a beginning time of the time slice, while $CapEndTime_j$ refers to an end time of the time slice;

$AptCap_{i,j}$: a capacity value of the airport $APT_i$ in the $j^{th}$ time slice;

$SectorCap_{i,j}$: a capacity value of the sector $SECTOR_i$ in the $j^{th}$ time slice;

$AptAAR_{i,j}$: an arrival capacity (arrival rate) of the airport $APT_i$ in the $j^{th}$ time slice;

$AptADR_{i,j}$: a departure capacity (departure rate) of the airport APT in the $j^{th}$ time slice;

$Dep_{i,j}$: a number of flights departing in the $j^{th}$ time slice in the airport $APT_i$; and $Arr_{i,j}$: a number of flights arrival in the $j^{th}$ time slice in the airport $APT_i$.

The step 1-2 comprises:

step 1-2-1: acquiring national airspace basic data:

acquiring basis information of all national airports and sectors according to the set analysis date ANA_DATE.

acquiring information of all national airports and forming the airport array APTLIST, wherein a total number of airports is AptTotalNum; and the specific information of each airport $APT_i$ in APTLIST comprises: the code $APT_i$(CODE); and acquiring information of all national sectors and forming the sector array SECTORLIST, wherein a total number of sectors is SectorTotalNum; and the specific information of each sector $SECTOR_i$ in SECTORLIST comprises: the code SECTOR (CODE).

Step 1-2-2: extracting a national flight plans:

according to the set analysis date ANA_DATE, filtering flight plans that depart from or arrive at a domestic airport, or appear in a domestic airspace within the date from a flight schedule to form the national flight plan array FltListIni, wherein a total number of plans is FltTotalNumIni; and generating trajectory prediction information of each flight plan $Flt_i$ in FltListIni by using a 4D trajectory predicting technology, wherein $i \in [1, FltTotalNumIni]$; and the trajectory prediction information comprising: the flight identity $ACID_i$, the departure airport $DepApt_i$, the arrival airport $ArrApt_i$, the flight priority $Flt_i$ (PRIO), the estimated time of departure $ETD_i$, the estimated time of arrival $ETA_i$, and the sector-passing array $PassSectorList_i$;

wherein the sector-passing array $PassSectorList_i$ comprises a code $PassSector_{i,j}$(Code) of each sector $PassSector_{i,j}$ passed by $Flt_i$, and a estimated sector-entry time $PassSector_{i,j}$(InETO); and an initial value of the flight priority $Flt_i$ (PRIO) is 0, which may be set by the user as needed.

Note: the 4D trajectory predicting technology is a general technology in a civil aviation air traffic control system, which can predict key points and sector information of each airway passed by the flight according to the flight plan of the flight. The 4D trajectory predicting technology will not be described in detail here as it is not the key point herein.

Step 1-2-3: acquiring national airspace capacity data:

1) Setting the computing time range:

generating the computing time range [tBgnTime, tEndTime] of the method according to the set analysis date ANA_DATE, wherein tBgnTime refers to 00:00:00 of the analysis date ANA_DATE, while tEndTime refers to 23:59:59 of the analysis date ANA_DATE.

2) Dividing the time slices:

the default time slice CapSpanTime in the method refers to 3,600 seconds (i.e., 1 hour), and may be adjusted by the user as needed;

A number *CapSpanNum* of the time slices is: $CapSpanNum = \frac{tEndTime - tBgnTime}{CapSpanTime}$ (1)

letting each time slice be [$CapBgnTime_j$, $CapEndTime_j$), $j \in CapSpanNum$, wherein $CapBgnTime_j$ refers to a beginning time of a $j^{th}$ time slice, while $CapEndTime_j$ refers to an end time of the $j^{th}$ time slice, and $CapEndTime_j = CapBgnTime_j + CapSpanTime$.

3) Acquiring a capacity of each time slice of national airports:

filtering capacity information $AptCap_{i,j}$ (capacity value of $APT_i$ in the $j^{th}$ time slice) of each time slice of each airport $APT_i$ in the array APTLIST within the computing time range [tBgnTime, tEndTime].

4) Acquiring a capacity of each time slice of national sectors:

filtering capacity information $SectorCap_{i,j}$ (capacity value of $SECTOR_i$ in the $j^{th}$ time slice) of each time slice of each sector $SECTOR_i$ in the array SECTORLIST within the computing time range [tBgnTime, tEndTime].

Note: the capacity information may come from static capacity data of national airports and sectors in published by Air Traffic Management Bureau, and may be modified or set by the user as needed.

The step 1-3 comprises:

step 1-3-1: decomposing the arrival capacity and the departure capacity of the airport;

The user may set the arrival capacity and the departure capacity of the airport as needed. If the arrival capacity and the departure capacity are not set, the arrival capacity and the departure capacity can be calculated by the following methods.

The following operations are carried out for each airport $APT_i$ in the array APTLIST:

1) Counting departure and arrival demand of each time slice of the airport:

according to the departure airport, the arrival airport, the estimated time of departure $ETD_i$ and the estimated time of arrival $ETA_i$ of each flight $Flt_i$ in the national flight plan array FltListIni, counting departure flights $Dep_{i,j}$ and arrival flights $Arr_{i,j}$ of each time slice j of the airport APT in the computing time range [tBgnTime, tEndTime].

2) Dividing the capacity according to the departure and arrival demand:

In order to improve the utilization of the airport capacity resources, the capacity of the airport is decomposed according to the departure and arrival demand of each time slice.

Thus, $$AptAAR_{i,j} = \begin{cases} \frac{Arr_{i,j}}{(Dep_{i,j} + Arr_{i,j})} * AptCap_{i,j}, (Dep_{i,j} + Arr_{i,j}) > 0 \\ \frac{1}{2} * AptCap_{i,j}, (Dep_{i,j} + Arr_{i,j}) \leq 0 \end{cases} \quad (2)$$

and $$AptADR_{i,j} = AptCap_{i,j} - AptAAR_{i,j}. \quad (3)$$

Step 1-3-2: acquiring flight sequencing information:

considering a national airspace service capacity, and aiming at ensuring that national airports and sectors do not exceed the capacity, a combination method of time adjustment and flight deletion is adopted to adjust the flights in FltListIni, and generate sequencing information of each flight $Flt_i$, wherein the sequencing information comprises: the sequenced time of departure $STD_i$, the sequenced time of arrival $STA_i$, a sequencing delay $DepDelay_i$, a flight adjustment mode $AdjMark_i$, and an sequenced sector-entry time $PassSector_{i,j}$(InSTO) of each sector $PassSector_{i,j}$ in the sector-passing array $PassSectorList_i$.

Note: the related flight sequencing method has been detailed in the earlier patent "Flight Operation Efficiency Pre-evaluation Method Based on Flight Schedule", and will not be elaborated herein.

Step 2: analyzing flight operation efficiency according to an airspace service capability.

The function of this step is: to filter the flights that cannot be executed normally by the original flight plan according to the national airport and sector capacity limits, generate the flight adjustment array, and further analyze the flight operation efficiency.

The following steps are comprised:

step 2-1: defining variables;

step 2-2: filtering flights that need to be adjusted;

step 2-3: optimizing a sequence of flight adjustment arrays; and step 2-4: analyzing the flight operation efficiency.

The step 2-1 comprises: defining the following variables:

FltList: a flight adjustment array, comprising all flights that need time adjustment or deletion in FltListIni;

FltTotalNum: a total number of flight plans in the array FltList, wherein an initial value is 0;

MAX_DELAY: a maximum flight delay default in this method, which is set as 9999*60 seconds in this method, and may be adjusted by the user as needed.

FltNormalNum: a number of flights in the national flights that need not be adjusted, wherein an initial value is 0;

FltDelayNum: a number of flights in the national flights that need to be delayed, wherein an initial value is 0;

FltDelNum: a number of flights in the national flights that need to be deleted, wherein an initial value is 0;

FltAccNum: a number of flights in the national flights that need time advance, wherein an initial value is 0;

FltAdjNum: a number of flights in the national flights that need time adjustment, wherein an initial value is 0; and FltNormality: normality estimation of the national flights, wherein an initial value is 0.

The step 2-2 comprises:

according to the flight sequencing information in the step 1-3-2, for each flight $Flt_i$ in the array FltListIni, when the flight satisfies that $AdjMark_i > 0$, indicating that the flight needs to be adjusted, adding the flight into the array FltList and letting:

FltTotalNum=FltTotalNum+1.

The step 2-3 comprises:

in order to distinguish the severity of flight operation problems, according to the flight sequencing information in the step 1-3-2, optimizing a sequence of the flights in the array FltList in a descending sequence of severity by comprehensively consider the delay situation $DepDelay_i$, the priority $Flt_i$(PRIO) and the adjustment mode $AdjMark_i$ of each flight $Flt_i$ in the array FltList, specifically comprising the following steps.

Step 2-3-1: updating delay information of flights suggested to be deleted:

for each flight $Flt_i$ in the array FltList, when the adjustment mode $AdjMark_i$ of the flight is 3, indicating that the flight is suggested to be deleted, letting the flight be that $DepDelay_i$=MAX_DELAY.

Step 2-3-2: sequencing according to the delay situations of the flights:

sequencing the flights in a descending sequence of delays according to the delay situation $DepDelay_i$ of each flight $Flt_i$ in FltList, and updating a flight sequence in the array FltList;

Step 2-3-3: sequencing according to the priorities of the flights:

in order to highlight the operation problems of high-priority flights, on the basis of the step 2-3-2, sequencing the flights in a descending sequence of priorities according to the priority $Flt_i$(PRIO) of each flight $Flt_i$ in the array FltList, and updating the flight sequence in the array FltList.

Step 2-4: analyzing the flight operation efficiency.

In this step, the national flight operation situation of the date ANA_DATE under the current airspace service capacity is analyzed according to the flight sequencing information in the step 1-3-2.

Step 2-4-1: calculating a flight delay number index:

for each flight $Flt_i$ in the array FltList, when satisfying that $AdjMark_i$ is 2, indicating that the flight is a delayed flight, and adding the flight into a delay number statistic magnitude, which denotes that FltDelayNum=FltDelayNum+1.

Step 2-4-2: calculating a flight deletion number index:

for each flight $Flt_i$ in the array FltList, when satisfying that $AdjMark_i$ is 3, indicating that the flight is a flight suggested to be deleted, and adding the flight into a deletion number statistic magnitude, which denotes that FltDelNum=FltDelNum+1.

Step 2-4-3: calculating a flight time advance number index:

for each flight $Flt_i$ in the array FltList, when satisfying that $AdjMark_i$ is 1, indicating that the flight is a time advanced flight, and adding the flight into a time advanced number statistic magnitude, which denotes that FltAccNum=FltAccNum+1.

Step 2-4-4: calculating a flight number index without adjustment:

In this method, the time-advanced flights are also regarded as the flights that need time adjustment, and the user may change a statistical mode as needed.

$$FltAdjNum=FltDelayNum+FltAccNum \tag{4}$$

$$FltNormalNum=FltTotalNumIni-FltAdjNum-FltDelNum \tag{5}$$

Step 2-4-5: calculating a flight normality index:

in this method, a proportion of flights that do not need to be adjusted is defined as the flight normality, wherein this index reflects a greatest normal running potential of the flight based on the current flight schedule.

A calculation formula is as follows:

$$FltNormality = \frac{FltNormalNum}{FltTotalNumIni} \tag{6}$$

Note: the Air Traffic Management Bureau of Civil Aviation Administration has published a variety of statistical methods of flight normality, which are constantly changing. In this patent, at a level of strategic air traffic flow management, the greatest potential of the normal operation of national flights under the current airspace service capacity is tapped, and an optimization solution is provided. Therefore, a flight normality statistical method is defined as formula (6), and a user may change the statistical method as needed.

Step 3: calculating the flight range that needs to be guaranteed by airspace expansion based on the flight normality target.

The function of this step is: to calculate the flight range that needs to be guaranteed by expanding the airspace service capacity according to the set flight normality optimization target.

The following steps are comprised:

step 3-1: defining variables;

step 3-2: making corresponding settings;

step 3-3: setting the flight normality optimization target; and step 3-4: calculating a flight volume that needs to be guaranteed by airspace expansion.

The step 3-1 comprises: defining the following variables:

TargetNormality: the flight normality optimization target set in the calculating process of the method;

TmpNormality: a flight normality temporary variable in the calculating process of the method;

TargetTotalNum: a total number of flights that need to be guaranteed by airspace expansion, wherein an initial value is 0;

TargetDelNum: a number of deleted flights that need to be guaranteed by airspace expansion, wherein an initial value is 0; and TargetAdjNum: a number of time adjusted flights that need to be guaranteed by airspace expansion, wherein an initial value is 0.

The step 3-2 comprises:

recording the existing airspace network as an airspace network A, it is obtained on the basis of the step 2-4 that the flight normality is estimated as FltNormality when the national flight plan array FltListIni runs in the airspace network A.

According to a sequencing result of the step 1-3-2, it can be known that flights in the flight adjustment array FltList that are not supported under a service capacity of the airspace network A are implemented according to original flight plan thereof; When the flight normality needs to be improved, a capacity of local airports or sectors in the airspace network A is expanded, so as to ensure that some flights in the array FltList can be implemented according to original flight plan thereof, and the airspace network with an expanded service capacity is recorded as an airspace network C. An expansion degree of the service capability of the airspace network A is related to the set normality optimization target TargetNormality and the flights selected for guarantee in the array FltList.

For the normality optimization target TargetNormality, the flight volume TargetTotalNum that needs to be guaranteed by airspace expansion filtered from FltList needs to satisfy a formula (7) and a formula (8):

$$TargetNormality = \frac{FltNormalNum + TargetAdjNum + TargetDelNum}{FltTotalNumIni}, \text{ and} \quad (7)$$

$$TargetAdjNum \in [0, FltAdjNum],\ TargetDelNum \in [0, FltDelNum]$$

$$TargetTotalNum = TargetAdjNum + TargetDelNum \quad (8)$$

In order to achieve the normality optimization target TargetNormality, this method generates the airspace network C by expanding the service capacity of the airspace network A, so as to ensure that TargetTotalNum flights in FltList can be implemented according to the original flight plan. On this premise, in order to prove that the national flight plan array FltListIni can achieve the flight normality optimization target TargetNormality when it is implemented in the airspace network C, the following explanations are needed.

To sum up, the airspace network C has the following features:

1) The airspace network C can support the selected flights to implement according to the original flight plan thereof by expanding the service capacity; and the newly added service capacity can only be used by these flights.
2) Except the selected TargetTotalNum flights, for the remaining flights in the national flight plan array FltListIni, according to the flight sequencing information in the step 1-3-2, the airspace network C can allocate the same time slot resources for these flights as the airspace network A.
3) According to the flight sequencing result in the step 1-3-2, the time slot resources originally occupied by the selected TargetTotalNum flights in the airspace network A will be recovered in the airspace network C, which may be used to support the selected TargetTotalNum flights to implement according to the original flight plan, or be re-allocated to other flights.

Figure 2:
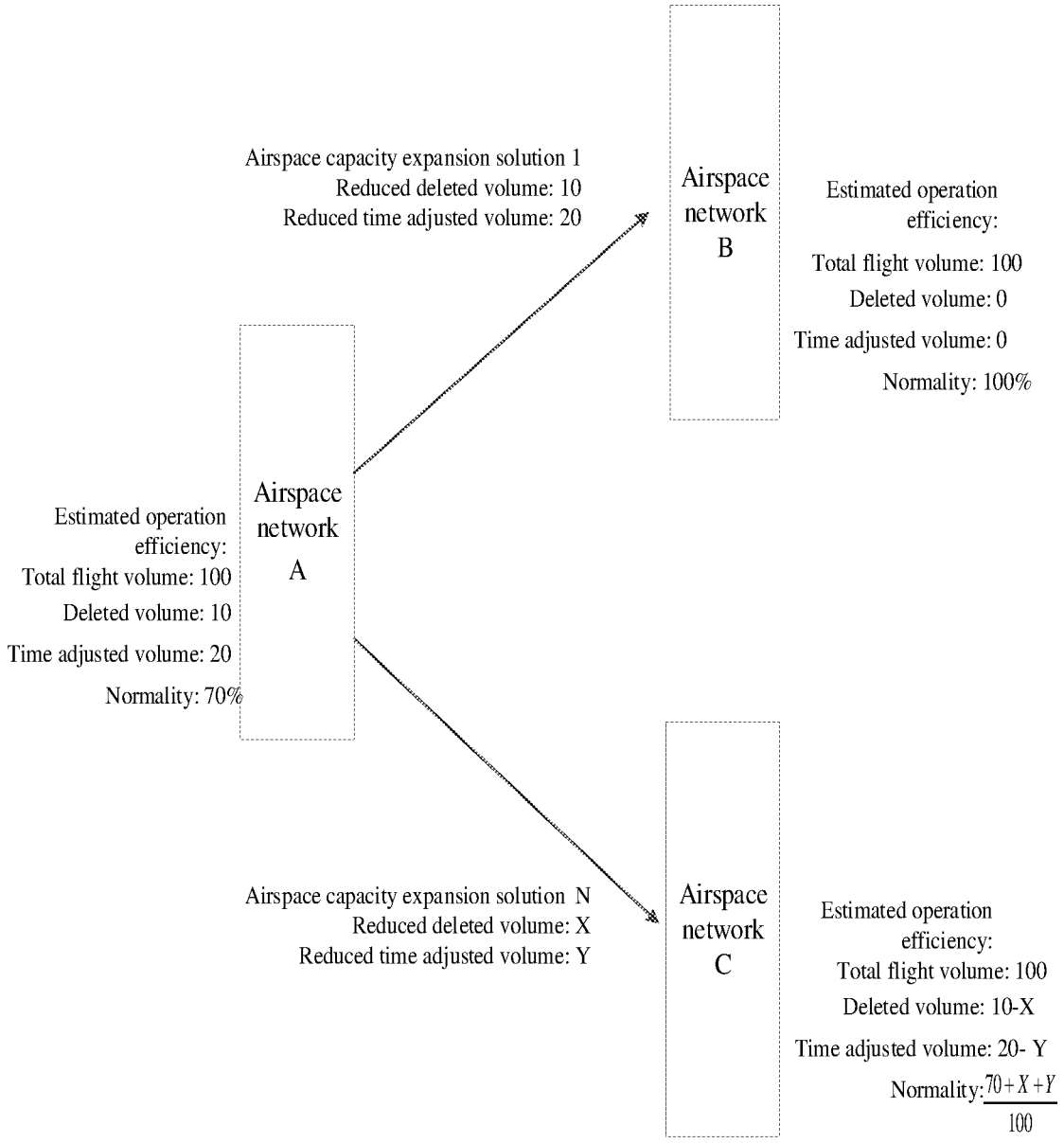
FIG. 2 is a schematic principle diagram of improving flight normality by increasing an airspace service capability of the present invention.

Therefore, except the selected TargetTotalNum flights, the airspace network C can provide a service capacity no lower than that of the airspace network A for the remaining flights in the national flight plan array FltListIni. If the remaining flights in the array FltListIni run in the airspace network C with reference to the flight sequencing information in the step 1-3-2, the airspace network C cannot exceed the service capacity. According to the above operation method, the remaining flights in the array FltListIni further comprise (FltAdjNum−TargetAdjNum) flights that need time adjustment and (FltDelNum−TargetDelNum) flights that need to be deleted. Combined with formula (9), it can be proved that there is at least one operation mode, so that the national flight plan array can achieve the flight normality optimization target when it is implemented in the airspace network C. The principle is shown in FIG. 2.

A formula for verifying the flight normality in the airspace network C is as follows:

$$TmpNormality = \frac{FltTotalNumIni - (FltAdjNum - TargetAdjNum) - (FltDelNum - TargetDelNum)}{FltTotalNumIni} \quad (9)$$

-continued $$= \frac{FltTotalNumIni - FltAdjNum - FltDelNum + TargetAdjNum + TargetDelNum}{FltTotalNumIni}$$

$$= \frac{FltNormalNum + TargetAdjNum + TargetDelNum}{FltTotalNumIni}$$

$$= TargetNormality$$

The step 3-3 comprises:

the object of the present invention is to expand the airspace service capability and improve the flight normality in actual operation. Therefore, it is necessary to limit the flight normality optimization target TargetNormality set by the user, which needs to satisfy that TargetNormality∈[FltNormality,1].

The step 3-4 comprises:

in order to achieve the flight normality optimization target TargetNormality, this step calculates the deleted flight volume TargetDelNum and the time-adjusted flight volume TargetAdjNum filtered out from the array FltList, and ensures that these flights can be implemented according to the original flight plan by expanding the airspace service capacity.

Considering that economic losses caused by flight deletion in actual operation are higher than that caused by flight delay, this method gives priority to the flight that may be deleted when filtering the flight range that needs to be guaranteed by airspace expansion, so as to reduce flight deletion behaviors in actual operation. The user may adjust preferences thereof for filtering flights as needed.

Step 3-4-1: calculating a deleted flight volume:

firstly, trying to incorporate only the flights suggested to be deleted into an guarantee range, and determining whether it is possible to achieve the normality optimization target:

$$\text{letting } TargetNormality = \frac{FltNormalNum + TargetDelNum}{FltTotalNumIni}, \text{ then:} \quad (10)$$

$$TargetDelNum = FltTotalNumIni * TargetNormality - FltNormalNum$$

when satisfying that TargetDelNum>FltDelNum, indicating that it is failed to achieve the flight normality target by guaranteeing the deleted flights only, letting TargetDelNum=FltDelNum, and continuously executing step 3-4-2; otherwise, letting TargetAdjNum=0, and skipping to step 3-4-3;

step 3-4-2: calculating a time-adjusted flight volume:

$$\text{letting } TargetNormality = \frac{FltNormalNum + TargetAdjNum + TargetDelNum}{FltTotalNumIni}, \text{ then:} \quad (11)$$

$$TargetAdjNum = TargetNormailty * FltTotalNumIni - TargetDelNum - FltNormalNum;$$

and step 3-4-3: calculating a total adjusted flight volume:

$$\text{TargetTotalNum=TargetDelNum+TargetAdjNum} \quad (12).$$

step 4: generating the airspace network optimization solution according to the flight that needs to be guaranteed.

Figure 3:
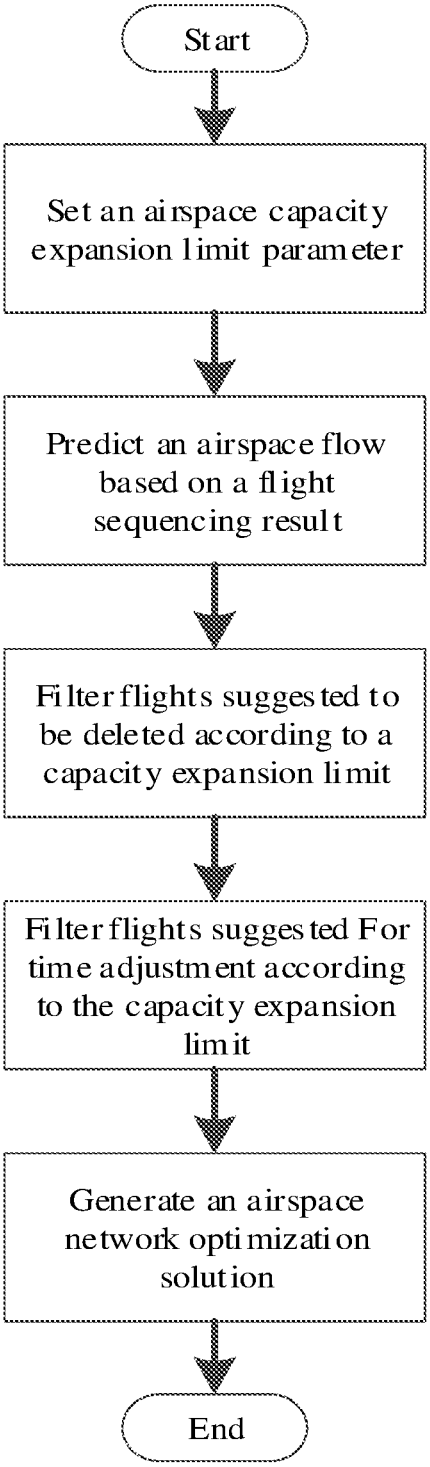
FIG. 3 is a processing flow chart of generating the airspace network optimization solution of the present invention.

The function of this step is: capable of positioning the key problem airspace according to the flight range that needs to be guaranteed, and provide suggestions for capacity optimization thereof. The processing flow is shown in FIG. 3.

The following steps are comprised:

step 4-1: defining variables;

step 4-2: setting parameters;

step 4-3: predicting an airspace flow based on a flight sequencing result; and step 4-4: generating an airspace network optimization solution.

The step 4-1 comprises: defining the following variables:

$AptCapMaxRatio_i$: an upper capacity increase limit of the airport APT in a unit of %, wherein an initial value is 100%;

$AptAARMaxRatio_i$: an upper arrival capacity increase limit of the airport APT in a unit of %, wherein an initial value is 100%;

$AptADRMaxRatio_i$: an upper departure capacity increase limit of the airport APT in a unit of %, wherein an initial value is 100%;

$SectorCapMaxRatio_i$: an upper capacity increase limit of the sector $SECTOR_i$ in a unit of %, wherein an initial value is 100%;

$DealMark_i$: a processing status of the flight $Flt_i$, wherein 0 represents not participating in the processing, and 1 represents being already processed;

$SectorSimuFlow_{i,j}$: a number of flights entering the sector $SECTOR_i$ in the $j^{th}$ time slice according to the flight sequencing result, wherein an initial value is 0;

$DepSimuFlow_{i,j}$: a number of flights departing in the $j^{th}$ time slice of the airport $APT_i$ according to the flight sequencing result, wherein an initial value is 0;

$ArrSimuFlow_{i,j}$: a number of flights arrived in the $j^{th}$ time slice of the airport $APT_i$ according to the flight sequencing result, wherein an initial value is 0;

$tmpSectorSimuFlow_{i,j}$: a temporary variable of the number of flights entering the sector $SECTOR_i$ in the $j^{th}$ time slice, wherein an initial value is 0;

$tmpDepSimuFlow_{i,j}$: a temporary variable of the number of flights departing in the j time slice of the airport $APT_i$, wherein an initial value is 0;

$tmpArrSimuFlow_{i,j}$: a temporary variable of the temporary variable of the number of flights arrived in the $j^{th}$ time slice of the airport $APT_i$ wherein an initial value is 0;

tmpDelCount: a temporary variable of the deleted flight volume in the calculating process of the method, wherein an initial value is 0;

tmpAdjCount: a temporary variable of the time-adjusted flight volume in the calculating process of the method, wherein an initial value is 0;

AspOptyList: an airspace network optimization solution obtained through the method, comprising a name, a type and a capacity increase value of an airspace needing to be optimized;

AspOptyListNum: a number of airspaces comprised in AspOptyList;

$AspOpty_i$: an $i^{th}$ airspace that needs to be optimized in:

$AspOpty_i$(CODE): an airspace code of $AspOpty_i$;

$AspOpty_i$(TYPE): an airspace type of $AspOpty_i$, wherein 0 represents the sector, and 1 represents the airport;

$AspOpty_i$(Cap): a capacity increase value of $AspOpty_i$, wherein an initial value is 0;

$AspOpty_i$(AAR): an arrival capacity increase value of $AspOpty_i$, which is only valid for airports, with an initial value of 0;

$AspOpty_i$ (ADR): a departure capacity increase value of $AspOpty_i$, which is only valid for airports, with an initial value of 0;

$MaxAspFlowVs_i$: a maximum value of a deviation between the flow and capacity of each time slice of an $i^{th}$ airspace object, wherein an initial value is 0;

$MaxDepFlowVs_i$: a maximum value of a deviation between the departure flights and departure capacity of each time slice of the $i^{th}$ airspace object, wherein an initial value is 0; and $MaxArrFlowVs_i$: a maximum value of a deviation between the arrival flights and arrival capacity of each time slice of the $i^{th}$ airspace object, wherein an initial value is 0.

Step 4-2: setting parameters.

In order to improve the feasibility of the airspace optimization solution, it is necessary to limit the maximum increase of each airspace.

Step 4-2-1: limiting airport capacity increase carrying out the following settings for each airport $APT_i$ in the national airport array APTLIST.

1) Limiting the airport capacity increase:

letting $AptCapMaxRatio_i$=120%, which may be modified by the user as needed.

2) Limiting the airport departure capacity increase:

letting $AptADRMaxRatio_i$=120%, which may be modified by the user as needed.

3) Limiting the airport arrival capacity increase:

letting $AptAARMaxRatio_i$=120%, which may be modified by the user as needed.

step 4-2-2: limiting sector capacity increase:

carrying out the following settings for each sector $SECTOR_i$ in the national sector array SECTORLIST.

letting $SectorCapMaxRatio_i$=120%, which may be modified by the user as needed.

Figure 4:
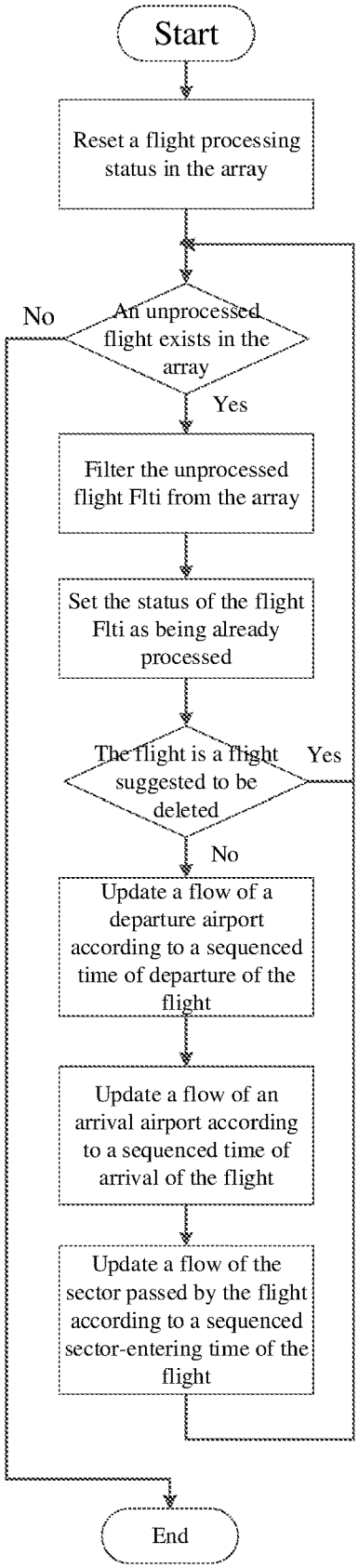
FIG. 4 is a processing flow chart of predicting an airspace flow based on a flight sequencing result of the present invention.

Step 4-3: predicting an airspace flow based on a flight sequencing result:

according to the flight sequencing result in the step 1-3-2, predicting national airport and sector flows; because the national airport and sector capacity limits are taken into account during the sequencing in the step 1-3-2, the flow value of each airspace object calculated here will not exceed the capacity limits thereof. The processing flow is shown in FIG. 4.

Step 4-3-1: clearing a flight processing status:

for each flight $Flt_i$ in the national flight plan array FltListIni, letting $DealMark_i$=0;

step 4-3-2: filtering flights to be processed:

starting from a first flight in the array FltListIni, taking the first flight the $DealMark_i$ of which is currently 0, letting $DealMark_i$=1, and executing step 4-3-3; when all the flights are processed, completing the calculation in the step 4-3;

step 4-3-3: judging a sequenced adjustment mode of the flights:

when the sequenced adjustment mode of the flight $AdjMark_i$ is 3, it is indicated that the flight is suggested to be deleted and is not necessary to participate in flow statistics, returning to step 4-3-2; otherwise, executing step 4-3-4;

step 4-3-4: updating a flow of the departure airport of the flight:

setting the flight $Flt_i$ to departure in a $k^{th}$ time slice of a $j^{th}$ airport APT in the array APTLIST according to the departure airport $DepApt_i$ and the sequenced time of departure $STD_i$ of the flight $Flt_i$, then letting $DepSimuFlow_{j,k}$=$DepSimuFlow_{j,k}$+1;

step 4-3-5: updating a flow of the arrival airport of the flight:

setting the flight $Flt_i$ to arrive in the $k^{th}$ time slice of the $j^{th}$ airport $APT_j$ in the array APTLIST according to the arrival airport $ArrApt_i$ and the sequenced time of arrival $STA_i$ of the flight $Flt_i$, then letting $ArrSimuFlow_{j,k}=ArrSimuFlow_{j,k}+1$; and step 4-3-6: updating a flow of the sector passed by the flight:

setting the flight $Flt_i$ to enter a $j^{th}$ sector $SECTOR_j$ of the array SECTORLIST in the $k^{th}$ time slice according to the sector array $PassSectorList_i$ passed by the flight $Flt_i$ and the sequenced sector-entry time $PassSector_{i,j}$(In-STO) of each sector $PassSector_{i,j}$ in the array, and letting $SectorSimuFlow_{j,k}=SectorSimuFlow_{j,k}+1$.

Returning to step 4-3-2.

The step 4-4 comprises:

according to the deleted flight volume TargetDelNum and the time-adjusted flight volume TargetAdjNum that need to be guaranteed by airspace expansion and obtained in the step 3-4, filtering the corresponding number of time adjusted flights and deleted flights from the flight adjustment array FltList, positioning the key problem airspace according to these flights, and providing capacity optimization suggestions.

Figure 5:
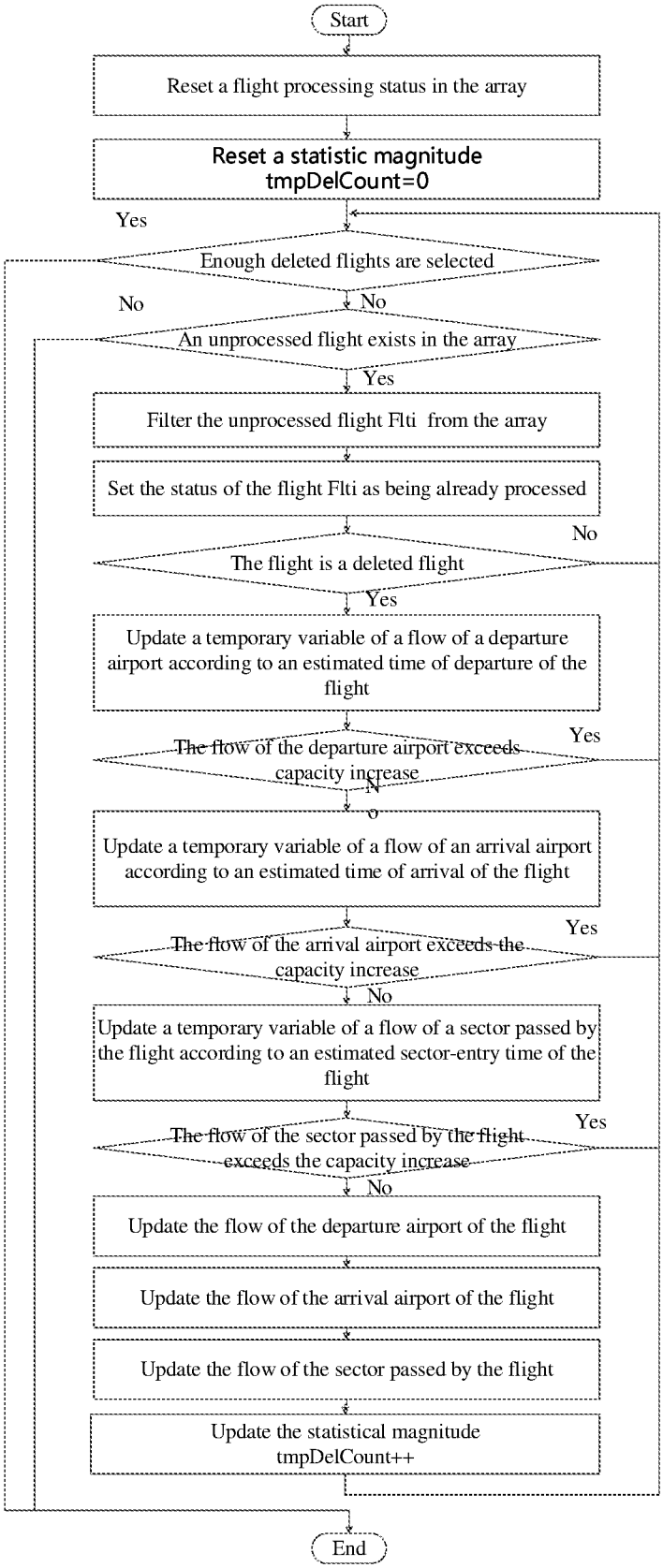
FIG. 5 is a processing flow chart of filtering flights suggested to be deleted according to an airspace expansion limit of the present invention.

Step 4-4-1: filtering the flights suggested to be deleted according to a capacity expansion limit:

considering the national airport and sector capacity increase limits, filtering TargetDelNum flights that are suggested to be deleted and need to be guaranteed by airspace expansion from the array FltList. The specific processing flow is shown in FIG. 5, which specifically comprises the following steps.

step 4-4-1-1: clearing the flight processing status:

for each flight $Flt_i$ in the flight adjustment array FltList, letting the flight processing status be that $DealMark_i=0$.

Letting tmpDelCount=0.

Step 4-4-1-2: judging whether the filtering is finished:

when satisfying that tmpDelCount>=TargetDelNum, or all the flights in the array FltList are already processed, which means that $DealMark_i$ is 1, finishing the processing of the step 4-4-1; otherwise, continuing subsequent processing.

Step 4-4-1-3: filtering flights to be processed:

starting from a first flight in the array FltList, taking the first flight $Flt_i$ the $DealMark_i$ of which is currently 0, letting $DealMark_i=1$, and developing subsequent operation.

Step 4-4-1-4: judging a sequenced adjustment mode of the flight:

when the sequenced adjustment mode $AdjMark_i$ of the flight is not 3, it is indicated that the flight does not belong to the flights suggested to be deleted, returning to step 4-4-1-2; otherwise, continuing subsequent operation.

Step 4-4-1-5: updating the flow of the departure airport of the flight:

setting the flight $Flt_i$ to departure in the $k^{th}$ time slice of the $j^{th}$ airport $APT_j$ in the array APTLIST according to the departure airport and the estimated time of departure $ETD_i$ of the flight $Flt_i$, then letting $tmpDepSimuFlow_{j,k}=DepSimuFlow_{j,k}$, and $tmpDepSimuFlow_{j,k}=tmpDepSimuFlow_{j,k}+1$.

Step 4-4-1-6: judging whether the flow of the departure airport of the flight exceeds the capacity increase:

when satisfying that $tmpDepSimuFlow_{j,k}>AptADR_1*AptADRMaxRatio_i$, returning to step 4-4-1-2; and when satisfying that $(tmpDepSimuFlow_{j,k}+ArrSimuFlow_{j,k})>AptCap_{j,k}*AptCapMaxRatio_j$, returning to step 4-4-1-2.

Step 4-4-1-7: updating the flow of the arrival airport of the flight:

setting the flight $Flt_i$ to arrive in the $k^{th}$ time slice of the $j^{th}$ airport $APT_j$ in the array APTLIST according to the arrival airport and the estimated time of arrival $ETA_i$ of the flight $Flt_i$, then letting $tmpArrSimuFlow_{j,k}=ArrSimuFlow_{j,k}$, and $tmpArrSimuFlow_{j,k}=tmpArrSimuFlow_{j,k}+1$.

Step 4-4-1-8: judging whether the flow of the arrival airport of the flight exceeds the capacity increase:

when satisfying that $tmpArrSimuFlow_{j,k}>AptAAR_{j,k}*AptAARMaxRatio_j$, returning to step 4-4-1-2; and when satisfying that $(tmpArrSimuFlow_{j,k}+DepSimuFlow_{j,k})>AptCap_1*AptCapMaxRatio_i$, returning to step 4-4-1-2.

Step 4-4-1-9: updating the flow of the sector passed by the flight:

setting the flight $Flt_i$ to enter the $j^{th}$ sector $SECTOR_j$ of the array SECTORLIST in the $k^{th}$ time slice according to the sector array $PassSectorList_i$ passed by the flight $Flt_i$ and the estimated sector-entry time $PassSector_{i,j}$(In-ETO) of each sector $PassSector_{i,j}$ in the array, then letting $tmpSectorSimuFlow_{j,k}=SectorSimuFlow_{j,k}$, and $tmpSectorSimuFlow_{j,k}=tmpSectorSimuFlow_{j,k}+1$.

Step 4-4-1-10: judging whether the flow of the sector passed by the flight exceeds the capacity increase:

for any sector $SECTOR_j$ passed by the flight $Flt_i$, when $tmpSectorSimuFlow_{j,k}>SectorCap_{j,k}*SectorCapMaxRatio_j$ is satisfied when the flight $Flt_i$ enters the sector $SECTOR_j$ in the $k^{th}$ time slice, returning to step 4-4-1-2.

Step 4-4-1-11: updating the selected deleted flight volume:

letting tmpDelCount=tmpDelCount+1;

for the departure airport of the flight $Flt_i$, setting that $DepSimuFlow_{j,k}=tmpDepSimuFlow_{j,k}$ for the airport;

for the arrival airport of the flight $Flt_i$, setting that $ArrSimuFlow_{j,k}=tmpArrSimuFlow_{j,k}$ for the airport; and for each sector $SECTOR_j$ passed by the flight $Flt_i$, letting $SectorSimuFlow_{j,k}=tmpSectorSimuFlow_{j,k}$; and returning to step 4-4-1-2.

Step 4-4-2: filtering the flights suggested for time adjustment according to the capacity expansion limit.

Figure 6:
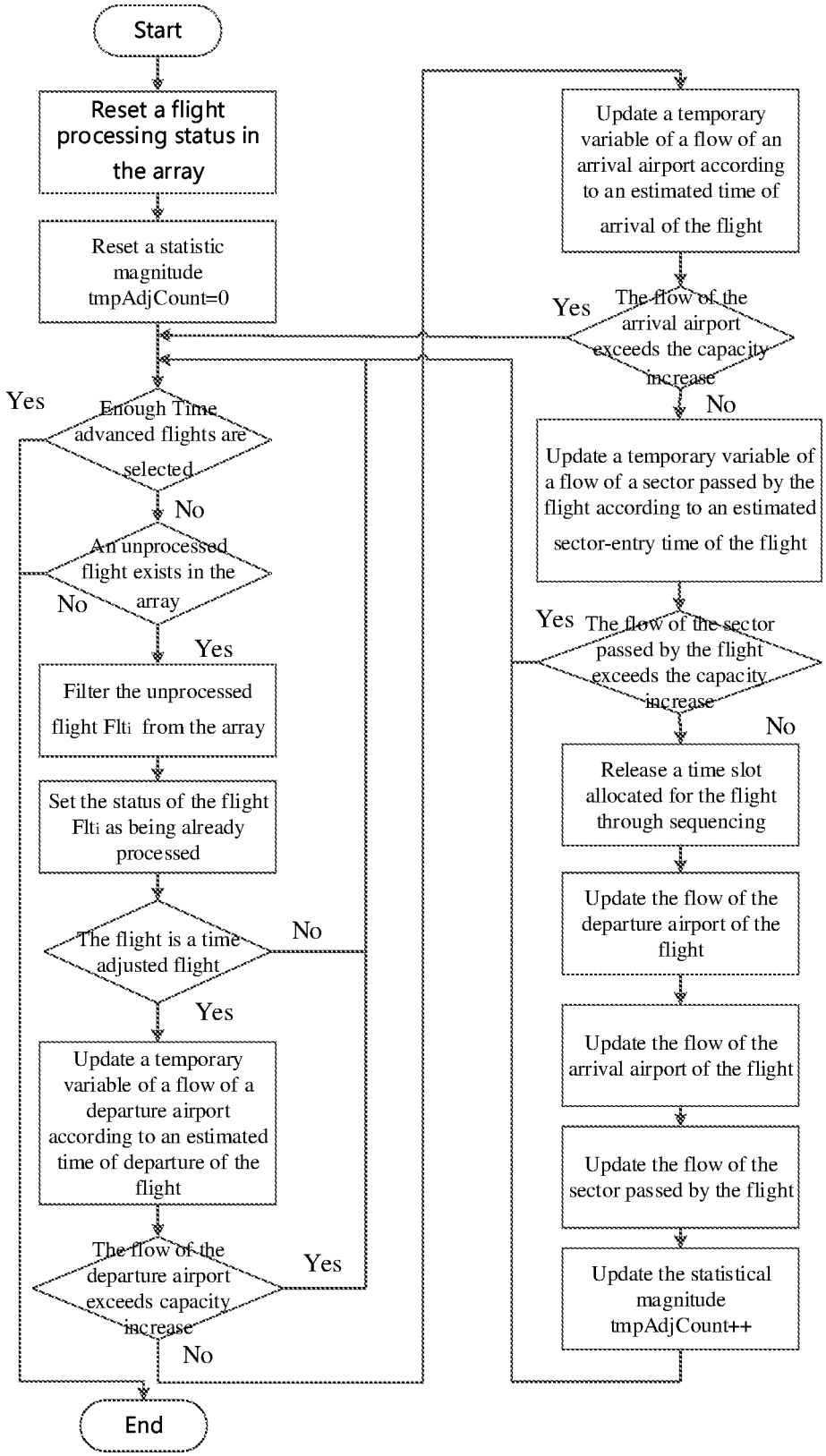
FIG. 6 is a processing flow chart of filtering flights suggested for time adjustment according to the airspace expansion limit of the present invention.

Considering the national airport and sector capacity increase limits, filtering TargetAdjNum flights that are suggested for time adjustment and need to be guaranteed by airspace expansion from the array FltList. The specific processing flow is shown in FIG. 6, which specifically comprises the following steps.

Step 4-4-2-1: clearing the flight processing status:

for each flight $Flt_i$ in the flight adjustment array FltList, letting the flight processing status be that $DealMark_i=0$; and letting tmpAdjCount=0.

Step 4-4-2-2: judging whether the filtering is finished:

when satisfying that tmpAdjCount>=TargetAdjNum, or all the flights in the array FltList are already processed, (i.e. $DealMark_i$ is 1), finishing the processing of the step 4-4-2; otherwise, continuing subsequent processing.

Step 4-4-2-3: filtering flights to be processed:

starting from the first flight in the array FltList, taking the first flight $Flt_i$ the $DealMark_i$ of which is currently 0, letting $DealMark_i=1$, and developing subsequent operation.

Step 4-4-2-4: judging a sequenced adjustment mode of the flight:

when the sequenced adjustment mode $AdjMark_i$ of the flight is 3, it is indicated that the flight does not belong to the flights suggested for time adjustment, returning to step 4-4-2-2; otherwise, continuing subsequent operation.

Step 4-4-2-5: updating a flow of the departure airport of the flight:

setting the flight $Flt_i$ to departure in the $k^{th}$ time slice of the $j^{th}$ airport $APT_j$ in the array APTLIST according to the departure airport and the estimated time of departure ETD of the flight $Flt_i$, then letting $tmpDepSimuFlow_{j,k}=DepSimuFlow_{j,k}$, and $tmpDepSimuFlow_{j,k}=tmpDepSimuFlow_{j,k}+1$; and setting the flight $Flt_i$ to departure in an $m^{th}$ time slice of the $j^{th}$ airport $APT_i$ in the array APTLIST according to the departure airport and the sequenced time of departure $STD_i$ of the flight $Flt_i$, then letting $tmpDepSimuFlow_{j,m}=DepSimuFlow_{j,m}$, and $tmpDepSimuFlow_{j,m}=tmpDepSimuFlow_{j,m}-1$.

Step 4-4-2-6: judging whether the flow of the departure airport exceeds the capacity increase:

when satisfying that $tmpDepSimuFlow_{j,k}>AptADR_{j,k}*AptADRMaxRatio_j$, returning to step 4-4-2-2; and when satisfying that $(tmpDepSimuFlow_{j,k}+ArrSimuFlow_{j,k})>AptCap_{j,k}*AptCapMaxRatio_j$, returning to step 4-4-2-2.

Step 4-4-2-7: updating a flow of the arrival airport of the flight:

setting the flight $Flt_i$ to arrive in the $k^{th}$ time slice of the $j^{th}$ airport $APT_j$ in the array APTLIST according to the arrival airport and the estimated time of arrival $ETA_i$ of the flight $Flt_i$, then letting $tmpArrSimuFlow_{j,k}=ArrSimuFlow_{j,k}$, and $tmpArrSimuFlow_{j,k}=tmpArrSimuFlow_{j,k}+1$; and setting the flight $Flt_i$ to arrive in the $m^{th}$ time slice of the $j^{th}$ airport $APT_j$ in the array APTLIST according to the arrival airport and the sequenced time of arrival $STA_i$ of the flight $Flt_i$, then letting $tmpArrSimuFlow_{j,m}=ArrSimuFlow_{j,m}$, and $tmpArrSimuFlow_{j,m}=tmpArrSimuFlow_{j,m}-1$.

Step 4-4-2-8: judging whether the flow of the arrival airport of the flight exceeds the capacity increase:

when satisfying that $tmpArrSimuFlow_{j,k}>AptAAR_{j,k}*AptAARMaxRatio_j$, returning to step 4-4-2-2; and when satisfying that $(tmpArrSimuFlow_{j,k}+DepSimuFlow_{j,k})>AptCap_{j,k}*AptCapMaxRatio_j$, returning to step 4-4-2-2.

Step 4-4-2-9: updating the flow of the sector passed by the flight:

supposing that the flight $Flt_i$ enters the $j^{th}$ sector $SECTOR_j$ of the array SECTORLIST in the $k^{th}$ time slice according to the sector array $PassSectorList_i$ passed by the flight $Flt_i$ and the estimated sector-entry time $PassSector_{i,j}$(InETO) of each sector $PassSector_{i,j}$ in the array, then letting $tmpSectorSimuFlow_{j,k}=SectorSimuFlow_{j,k}$, and $tmpSectorSimuFlow_{j,k}=tmpSectorSimuFlow_{j,k}+1$; and setting the flight $Flt_i$ to enter the $j^{th}$ sector $SECTOR_j$ of the array SECTORLIST in the $m^{th}$ time slice according to the sector array $PassSectorList_i$ passed by the flight $Flt_i$ and the sequenced sector-entry time $PassSector_{i,j}$(InSTO) of each sector $PassSector_{i,j}$ in the array, then, letting $tmpSectorSimuFlow_{j,m}=SectorSimuFlow_{j,m}$ and $tmpSectorSimuFlow_{j,m}=tmpSectorSimuFlow_{j,m}-1$.

Step 4-4-2-10: judging whether the flow of the sector passed by the flight exceeds the capacity increase:

for any sector $SECTOR_j$ passed by the flight $Flt_i$, when $tmpSectorSimuFlow_{j,k}>SectorCap_{j,k}*SectorCapMaxRatio_j$ is satisfied when the flight $Flt_i$ enters the sector $SECTOR_j$ in the $k^{th}$ time slice, returning to step 4-4-2-2.

Step 4-4-2-11: updating the selected time-adjusted flight volume:

letting tmpAdjCount=tmpAdjCount+1;

for the departure airport of the flight $Flt_i$, setting that $DepSimuFlow_{j,k}=tmpDepSimuFlow_{j,k}$ for the airport, and $DepSimuFlow_{j,m}=tmpDepSimuFlow_{j,m}$;

for the arrival airport of the flight $Flt_i$, setting that $ArrSimuFlow_{j,k}=tmpArrSimuFlow_{j,k}$ for the airport, and $ArrSimuFlow_{j,m}=tmpArrSimuFlow_{j,m}$; and for each sector $SECTOR_j$ passed by the flight $Flt_i$, letting $SectorSimuFlow_{j,k}=tmpSectorSimuFlow_{j,k}$, and $SectorSimuFlow_{j,m}=tmpSectorSimuFlow_{j,m}$; and returning to the step 4-4-2-2.

Figure 7:
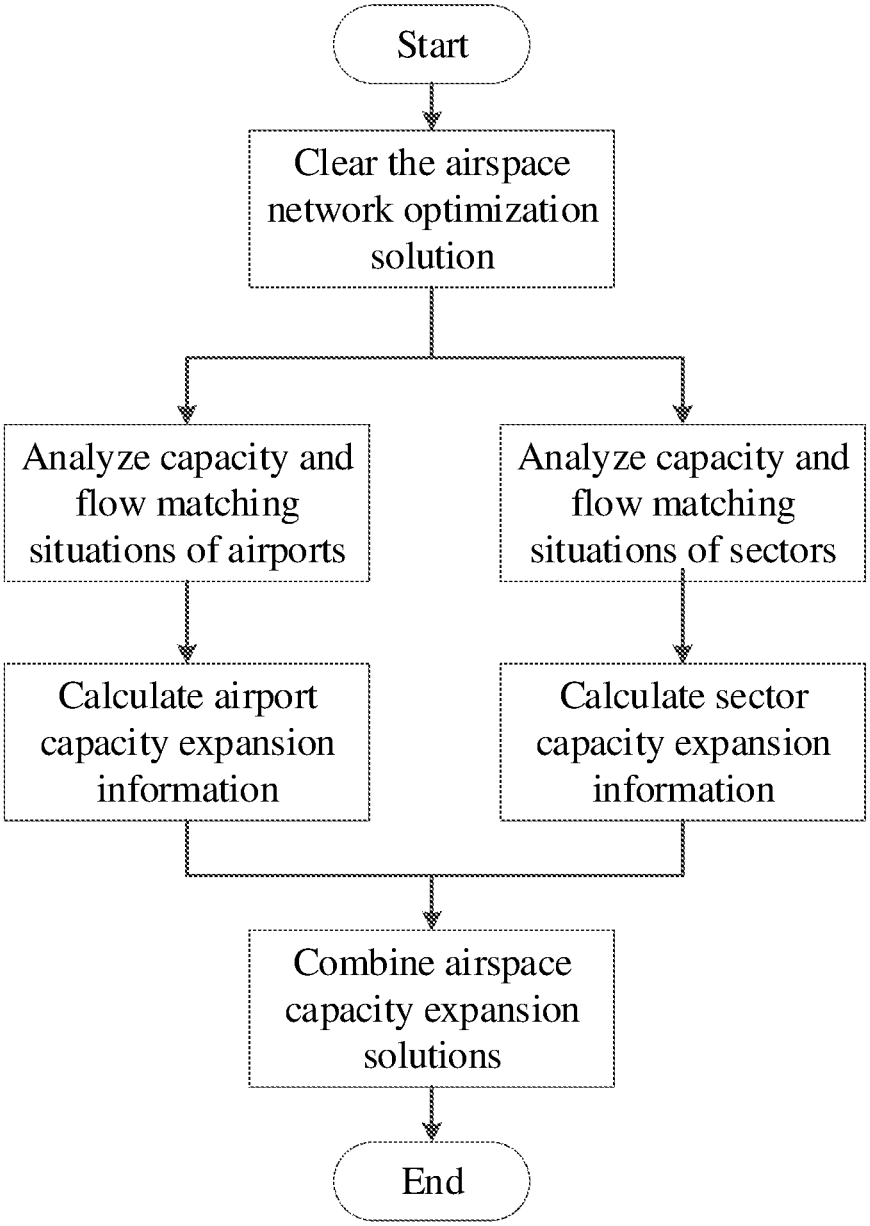
FIG. 7 is a flow chart of calculating airspace optimization information of the present invention.

Step 4-4-3: generating the airspace network optimization solution:

generating the, airspace network optimization solution according to the capacity and flow matching situations of national airports and sectors. The processing flow is shown in FIG. 7, which specifically comprises the following steps.

step 4-4-3: generating the airspace network optimization solution, specifically comprising the following steps of:

Step 4-4-3-1: clearing the solution:

clearing the airspace network optimization solution AspOptyList, and letting AspOptyListNum=0.

Step 4-4-3-2: counting airports needing to be optimized:

circularly carrying out the following processing for each airport $APT_i$ in the national airport array APTLIST.

Step 4-4-3-2-1: calculating the deviation between the flow and capacity of each time slice:

calculating a deviation $(DepSimuFlow_{i,j}-AptADR_{i,j})$ between a departure flow and a departure capacity, a deviation $(ArrSimuFlow_{i,j}-AptAAR_{i,j})$ between an arrival flow and an arrival capacity, and a deviation $(DepSimuFlow_{i,j}+ArrSimuFlow_{i,j}-AptCap_{i,j})$ between a total flow and a total capacity of the airport APT in each time slice J; and accordingly, calculating a maximum deviation $MaxDepFlowVs_i$ between the departure flow and the departure capacity, a maximum deviation $MaxArrFlowVs_i$ between the arrival flow and the arrival capacity, and a maximum deviation $MaxAspFlowVs_i$ between the total flow and the total capacity of the airport APT in each time slice J;

when $MaxDepFlowVs_i<0$, letting $MaxDepFlowVs_i=0$;

when $MaxArrFlowVs_i<0$, letting $MaxArrFlowVs_i=0$; and when $MaxAspFlowVs_i<0$, letting $MaxAspFlowVs_i=0$.

Step 4-4-3-2-2: filtering a capacity-expanded airport and calculating a capacity-expanded degree:

when the airport $APT_i$ satisfies that $(MaxDepFlowVs_i>0 \| MaxArrFlowVs_i>0 \| MaxAspFlowVs_i>0)$, defining the airport as an airspace to be optimized $AspOpty_k$, and letting $AspOpty_k(CODE)=APT_i(CODE)$, $AspOpty_k(TYPE)=1$, $AspOpty_k(Cap)=MaxAspFlowVs_i$, $AspOpty_k(AAR)=MaxArrFlowVs_i$ and $AspOpty_k(ADR)=MaxDepFlowVs_i$; and adding $AspOpty_k$ to the airspace network optimization solution AspOptyList, and letting AspOptyListNum=AspOptyListNum+1.

Step 4-4-3-3: counting sectors needing to be optimized:

circularly carrying out the following processing for each sector $SECTOR_i$ in the national sector array SECTORLIST.

Step 4-4-3-3-1: calculating the deviation between the flow and capacity of each time slice:

calculating a deviation ($SectorSimuFlow_{i,j}$−$SectorCap_{i,j}$) between the flow and the capacity of the sector $SECTOR_i$ in each time slice j, and accordingly, counting a maximum deviation $MaxAspFlowVs_i$ between the flow and the capacity of the sector $SECTOR_i$ in each time slice; and when $MaxAspFlowVs_i<0$, letting $MaxAspFlowVs_i=0$.

Step 4-4-3-3-2: filtering a capacity-expanded sector and calculating a capacity-expanded degree:

when the sector $SECTOR_j$ satisfies that $MaxAspFlowVs_i>0$, defining the sector $SECTOR_j$ as an airspace to be optimized $AspOpty_k$, and letting $AspOpty_k$(CODE)=$SECTOR_i$(CODE), $AspOpty_k$(TYPE)=0, and $AspOpty_k$(Cap)=$MaxAspFlowVs_i$; and adding $AspOpty_k$ to the airspace network optimization solution, and letting AspOptyListNum=AspOptyListNum+1.

The adjustment of the airplane flight is executed according to the airspace network optimization solution n obtained in the step 4.

The airspace network optimization method based on the flight normality target according to this embodiment is loaded and operated in a processing server an air traffic flow management system (ATFM system) or a corresponding computer of an air traffic control system (ATC system).

In a specific implementation, the present application provides a computer storage medium and a corresponding data processing unit, wherein the computer storage medium is capable of storing a computer program, and the computer program, when executed by the data processing unit, can run the inventive contents of the airspace network optimization method based on the flight normality target provided by the present invention and some or all steps in various embodiments. The storage medium may be a magnetic disk, an optical disk, a Read Only Storage (ROM) or a Random Access Storage (RAM), and the like.

Those skilled in the art can clearly understand that the technical solutions in the embodiments of the present invention can be realized by means of a computer program and a corresponding general hardware platform thereof. Based on such understanding, the essence of the technical solutions in the embodiments of the present invention or the part contributing to the prior art, may be embodied in the form of a computer program, i.e., a software product. The computer program, i.e., the software product is stored in a storage medium comprising a number of instructions such that a device (which may be a personal computer, a server, a singlechip, a MUU or a network device, and the like) comprising the data processing unit executes the methods described in various embodiments or some parts of the embodiments of the present invention.

What is claimed is:

1. An airspace network optimization method based on a flight normality target, comprising a computer readable medium operable on a computer with memory for the airspace network optimization method, and comprising program instructions for executing the following steps of:

step 1: preparing basic data by acquiring required calculating data and performing preliminary processing on the data;

step 2: analyzing a flight operation efficiency according to an airspace service capability;

step 3: calculating a flight range that needs to be guaranteed by airspace expansion based on the flight normality target;

step 4: generating an airspace network optimization solution according to the flight that needs to be guaranteed;

the step 1 comprises the following steps of:

step 1-1: defining variables;

step 1-2: acquiring the basic data; and step 1-3: processing the basic data;

the step 1-1 comprises the step of defining the following variables:

ANA_DATE: analysis date;

FltListIni: a national flight plan array, comprising all flight plans related to the analysis date ANA_DATE;

FltTotalNumIni: a total number of flight plan in the national flight plan array FltListIni;

$Flt_i$: an $i^{th}$ flight plan in the national flight plan array FltListIni;

$ACID_i$: a flight identity in the $i^{th}$ flight plan $Flt_i$;

$Flt_i$(PRIO): a priority of the $i^{th}$ flight plan $Flt_i$, wherein the value is a non-negative integer with an initial value of 0;

$DepApt_i$: a departure airport of the $i^{th}$ flight plan $Flt_i$;

$ArrApt_i$: an arrival airport of the $i^{th}$ flight plan $Flt_i$;

$ETD_i$: an estimated time of departure of the $i^{th}$ flight plan $Flt_i$;

$ETA_i$: an estimated time of arrival of the $i^{th}$ flight plan $Flt_i$;

$STD_i$: a sequenced time of departure of the $i^{th}$ flight plan $Flt_i$, with an initial value of $ETD_i$;

$STA_i$: a sequenced time of arrival of the $i^{th}$ flight plan $Flt_i$, with an initial value of $ETA_i$;

$DepDelay_i$: a sequenced departure delay of the $i^{th}$ flight plan $Flt_i$;

$AdjMark_i$: a sequenced adjustment mode of the $i^{th}$ flight plan $Flt_i$, wherein 0 represents unadjustment, 1 represents time advance, 2 represents delay, 3 represents deletion, and an initial value is 0;

$PassSectorList_i$: a sector-passing array of the $i^{th}$ flight plan $Flt_i$, comprising information of all sectors passed by the $i^{th}$ flight plan $Flt_i$;

$PassSector_{i,j}$: information of a $j^{th}$ sector in the sector-passing array $PassSectorList_i$ of the $i^{th}$ flight plan $Flt_i$;

$PassSector_{i,j}$(Code): a code of the $j^{th}$ sector $PassSector_{i,j}$ in the sector-passing array $PassSectorList_i$ of the $i^{th}$ flight plan $Flt_i$;

$PassSector_{i,j}$(InETO): an estimated entry time of the $j^{th}$ sector $PassSector_{i,j}$ in the sector-passing array $PassSectorList_i$ of the $i^{th}$ flight plan $Flt_i$;

$PassSector_{i,j}$(InSTO): a sequenced entry time of the $j^{th}$ sector $PassSector_{i,j}$ in the sector-passing array $PassSectorList_i$ of the $i^{th}$ flight plan $Flt_i$;

APTLIST: an airport array, comprising information of all national airports;

AptTotalNum: a number of airports comprised in the airport array APTLIST;

$APT_i$: an $i^{th}$ airport in the airport array APTLIST;

$APT_i$(CODE): a four-character code of the airport $APT_i$;

SECTORLIST: a sector array, comprising information of all national sectors;

SectorTotalNum: a number of sectors comprised in the sector array SECTORLIST;

$SECTOR_i$: an $i^{th}$ sector in the sector array SECTORLIST;

$SECTOR_i$(CODE): a code of the sector:

[tBgnTime, tEndTime]: a computing time range, wherein tBgnTime refers to 00:00:00 of the analysis date ANA_DATE, while tEndTime refers to 23:59:59 of the analysis date ANA_DATE;

CapSpanTime: a time slice span;

CapSpanNum: a number of time slices in the computing time range, with an initial value of 0;

[$CapBgnTime_j$,$CapEndTime_j$): a $j^{th}$ time slice in the computing time range [tBgnTime, tEndTime], wherein $CapBgnTime_j$ refers to a beginning time of the time slice, while $CapEndTime_j$ refers to an end time of the time slice;

$AptCap_{i,j}$: a capacity value of the airport $APT_i$ in the $j^{th}$ time slice;

$SectorCap_{i,j}$: a capacity value of the sector $SECTOR_i$ in the $j^{th}$ time slice;

$AptAAR_{i,j}$: an arrival capacity of the airport $APT_i$ in the $j^{th}$ time slice;

$AptADR_{i,j}$: a departure capacity of the airport $APT_i$ in the $j^{th}$ time slice;

$Dep_{i,j}$: a number of flights departing in the $j^{th}$ time slice in the airport $APT_i$; and $Arr_{i,j}$: a number of flights arrival in the $j^{th}$ time slice in the airport $APT_i$;

the step 1-2 comprises:

step 1-2-1: acquiring national airspace basic data:

acquiring basis information of all national airports and sectors according to the set analysis date ANA_DATE;

acquiring information of all national airports and forming the airport array APTLIST, wherein a total number of airports is AptTotalNum; and the specific information of each airport $APT_i$ in APTLIST comprises: the code $APT_i$(CODE); and acquiring information of all national sectors and forming the sector array SECTORLIST, wherein a total number of sectors is SectorTotalNum; and the specific information of each sector $SECTOR_i$ in SECTORLIST comprises: the code $SECTOR_i$(CODE);

step 1-2-2: extracting national flight plans:

according to the set analysis date ANA_DATE, filtering flight plans that depart from or arrive at a domestic airport, or appear in a domestic airspace within the date from a flight schedule to form the national flight plan array FltListIni, wherein a total number of plans is FltTotalNumIni; and generating trajectory prediction information of each flight plan $Flt_i$ in FltListIni, wherein $i \in [1, FltTotalNumIni]$;

the trajectory prediction information comprising: the flight identity $ACID_i$, the departure airport $DepApt_i$, the arrival airport $ArrApt_i$, the flight priority $Flt_i$(PRIO), the estimated time of departure $ETD_i$, the estimated time of arrival $ETA_i$, and the sector-passing array $PassSectorList_i$;

wherein the sector-passing array $PassSectorList_i$ comprises a code $PassSector_{i,j}$(Code) of each sector $PassSector_{i,j}$ passed by $Flt_i$, and a estimated sector-entry time $PassSector_{i,j}$(InETO); and an initial value of the flight priority $Flt_i$(PRIO) is 0; and step 1-2-3: acquiring national airspace capacity data:

setting the computing time range:

generating the computing time range [tBgnTime, tEndTime] according to the set analysis date ANA_DATE, wherein tBgnTime refers to 00:00:00 of the analysis date ANA_DATE, while tEndTime refers to 23:59:59 of the analysis date ANA_DATE;

dividing the time slices:

a number of the time slices being:

$$CapSpanNum = \frac{tEndTime - tBgnTime}{CapSpanTime} \tag{1}$$

letting each time slice be [$CapBgnTime_j$, $CapEndTime_j$), $j \in CapSpanNum$, wherein $CapBgnTime_j$ refers to a beginning time of a $j^{th}$ time slice, while $CapEndTime_j$ refers to an end time of the $j^{th}$ time slice, and $CapEndTime_j = CapBgnTime_j + CapSpanTime$;

acquiring a capacity of each time slice of national airports:

filtering capacity information $AptCap_{i,j}$ of each time slice of each airport $APT_i$ in the array APTLIST within the computing time range [tBgnTime, tEndTime]; and acquiring a capacity of each time slice of national sectors:

filtering capacity information $SectorCap_{i,j}$ of each time slice of each sector $SECTOR_i$ in the array SECTORLIST within the computing time range [tBgnTime, tEndTime];

the step 1-3 comprises:

step 1-3-1: decomposing the arrival capacity and the departure capacity of the airport;

carrying out the following operations for each airport $APT_i$ in the array APTLIST:

counting departure and arrival demand of each time slice of the airport:

according to the departure airport, the arrival airport, the estimated time of departure $ETD_i$ and the estimated time of arrival $ETA_i$ of each flight $Flt_i$ in the national flight plan array FltListIni, counting departure flights $Dep_{i,j}$ and arrival flights $Arr_{i,j}$ of each time slice j of the airport $APT_i$ in the computing time range [tBgnTime, tEndTime];

dividing the capacity according to the departure and arrival demand:

decomposing the capacity of the airport according to the departure and arrival demand of each time slice:

$$AptAAR_{i,j} = \begin{cases} \dfrac{Arr_{i,j}}{(Dep_{i,j} + Arr_{i,j})} * AptCap_{i,j}, & (Dep_{i,j} + Arr_{i,j}) > 0 \\ \dfrac{1}{2} * AptCap_{i,j}, & (Dep_{i,j} + Arr_{i,j}) \le 0 \end{cases} \tag{2}$$

$$AptADR_{i,j} = AptCap_{i,j} - AptAAR_{i,j}; \tag{3}$$

and step 1-3-2: acquiring flight sequencing information:

generating sequencing information of each flight $Flt_i$, wherein the sequencing information comprises the sequenced time of departure $STD_i$, the sequenced time of arrival $STA_i$, a sequencing delay $DepDelay_i$, a flight adjustment mode $AdjMark_i$, and an sequenced sector-entry time $PassSector_{i,j}$(InSTO) of each sector $PassSector_{i,j}$ in the sector-passing array $PassSectorList_i$;

the step 2 comprises the following steps of:

step 2-1: defining variables;

step 2-2: filtering flights that need to be adjusted;

step 2-3: optimizing a sequence of flight adjustment arrays; and step 2-4: analyzing the flight operation efficiency;

the 2-1 comprises the step of defining the following variables:

FltList: a flight adjustment array, comprising all flights that need time adjustment or deletion in FltListIni;

FltTotalNum: a total number of flight plans in the array FltList, wherein an initial value is 0;

MAX_DELAY: a default maximum flight delay;

FltNormalNum: a number of flights in the national flights that need not be adjusted, wherein an initial value is 0;

FltDelayNum: a number of flights in the national flights that need to be delayed, wherein an initial value is 0;

FltDelNum: a number of flights in the national flights that need to be deleted, wherein an initial value is 0;

FltAccNum: a number of flights in the national flights that need time advance, wherein an initial value is 0;

FltAdjNum: a number of flights in the national flights that need time adjustment, wherein an initial value is 0; and FltNormality: normality estimation of the national flights, wherein an initial value is 0;

the step 2-2 comprises:

according to the flight sequencing information in the step 1-3-2, for each flight $Flt_i$ in the array FltListIni, when the flight satisfies that $AdjMark_i>0$, indicating that the flight needs to be adjusted, adding the flight into the array FltList and letting: FltTotalNum=FltTotalNum+1;

the step 2-3 comprises:

according to the flight sequencing information in the step 1-3-2, optimizing a sequence of the flights in the array FltList in a descending sequence of severity by comprehensively consider the delay situation $DepDelay_i$, the priority $Flt_i$ (PRIO) and the adjustment mode $AdjMark_i$ of each flight $Flt_i$ in the array FltList, specifically comprising the following steps of:

step 2-3-1: updating delay information of flights suggested to be deleted:

for each flight $Flt_i$ in the array FltList, when the adjustment mode $AdjMark_i$ of the flight is 3, indicating that the flight is suggested to be deleted, letting the flight be that $DepDelay_i$=MAX_DELAY;

step 2-3-2: sequencing according to the delay situations of the flights:

sequencing the flights in a descending sequence of delays according to the delay situation $DepDelay_i$ of each flight $Flt_i$ in FltList, and updating a flight sequence in the array FltList;

step 2-3-3: sequencing according to the priorities of the flights:

on the basis of the step 2-3-2, sequencing the flights in a descending sequence of priorities according to the priority $Flt_i$(PRIO) of each flight $Flt_i$ in the array FltList, and updating the flight sequence in the array FltList; and the step 2-4 comprises:

step 2-4-1: calculating a flight delay number index:

for each flight $Flt_i$, in the array FltList, when satisfying that $AdjMark_i$ is 2, indicating that the flight is a delayed flight, and adding the flight into a delay number statistic magnitude, which denotes that FltDelayNum=FltDelayNum+1;

step 2-4-2: calculating a flight deletion number index:

for each flight $Flt_i$ in the array FltList, when satisfying that $AdjMark_i$ is 3, indicating that the flight is a flight suggested to be deleted, and adding the flight into a deletion number statistic magnitude, which denotes that FltDelNum=FltDelNum+1;

step 2-4-3: calculating a flight time advance number index:

for each flight $Flt_i$ in the array FltList, when satisfying that $AdjMark_i$ is 1, indicating that the flight is a time advanced flight, and adding the flight into a time advanced number statistic magnitude, which denotes that FltAccNum=FltAccNum+1;

step 2-4-4: calculating a flight number index without needing adjustment:

taking the time advanced flight also as the flight needing time adjustment:

$$FltAdjNum=FltDelayNum+FltAccNum \tag{4}$$

$$FltNormalNum=FltTotalNumIni-FltAdjNum-FltDelNum \tag{5}$$ ; and step 2-4-5: calculating a flight normality index:

a calculation formula being as follows:

$$FltNormality=\frac{FltNormalNum}{FltTotalNumIni}. \tag{6}$$

the step 3 comprises the following steps of:

step 3-1: defining variables;

step 3-2: making corresponding settings;

step 3-3: setting the flight normality optimization target; and step 3-4: calculating a flight volume that needs to be guaranteed by airspace expansion;

the step 3-1 comprises: defining the following variables:

TargetNormality: the flight normality optimization target;

TmpNormality: a flight normality temporary variable;

TargetTotalNum: a total number of flights that need to be guaranteed by airspace expansion, wherein an initial value is 0;

TargetDelNum: a number of deleted flights that need to be guaranteed by airspace expansion, wherein an initial value is 0; and TargetAdjNum: a number of time adjusted flights that need to be guaranteed by airspace expansion, wherein an initial value is 0;

the step 3-2 comprises:

recording the existing airspace network as an airspace network A, it is obtained on the basis of the step 2-4 that the flight normality is estimated as FltNormality when the national flight plan array FltListIni runs in the airspace network A; and according to a sequencing result of the step 1-3-2, implementing flights in the flight adjustment array FltList that are not supported under a service capacity of the airspace network A according to original flight plan thereof; when the flight normality needs to be improved, expanding a capacity of local airports or sectors in the airspace network A, and recording the airspace network with an expanded service capacity as an airspace network C; wherein, an expansion degree of the service capability of the airspace network A is related to the set normality optimization target TargetNormality and the flights selected for guarantee in the array FltList; and for the normality optimization target TargetNormality, the flight volume TargetTotalNum that needs to be guaranteed by airspace expansion filtered from FltList needs to satisfy a formula (7) and a formula (8):

$$TargetNormality=\frac{FltNormalNum+TargetAdjNum+TargetDelNum}{FltTotalNumIni}, \text{ and} \tag{7}$$

-continued $$TargetAdjNum \in [0, FltAdjNum],\ TargetDelNum \in [0, FltDelNum]$$

$$TargetTotalNum = TargetAdjNum + TargetDelNum \quad (8)$$

a formula for verifying the flight normality in the airspace network C is as follows:

$$\begin{aligned} TmpNormality &= \frac{FltTotalNumIni - (FltAdjNum - TargetAdjNum) - (FltDelNum - TargetDelNum)}{FltTotalNumIni} \\ &= \frac{FltTotalNumIni - FltAdjNum - FltDelNum + TargetAdjNum + TargetDelNum}{FltTotalNumIni} \\ &= \frac{FltNormalNum + TargetAdjNum + TargetDelNum}{FltTotalNumIni} \\ &= TargetNormality \end{aligned} \quad (9)$$

the step 3-3 comprises:

limiting the flight normality optimization target TargetNormality set by a user, which needs to satisfy that TargetNormality∈[FltNormality,1]; and the step 3-4 comprises:

step 3-4-1: calculating a deleted flight volume:

firstly, trying to incorporate only the flights suggested to be deleted into an guarantee range, and determining whether it is possible to achieve the normality optimization target:

$$\text{letting } TargetNormality = \frac{FltNormalNum + TargetDelNum}{FltTotalNumIni}, \text{ then:} \quad (10)$$

$$TargetDelNum = FltTotalNumIni^{*}\ TargetNormality - FltNormalNum$$

when satisfying that TargetDelNum>FltDelNum, indicating that it is failed to achieve the flight normality target by guaranteeing the deleted flights only, letting TargetDelNum=FltDelNum, and continuously executing step 3-4-2; otherwise, letting TargetAdjNum=0, and skipping to step 3-4-3;

step 3-4-2: calculating a time-adjusted flight volume:

$$\text{letting } TargetNormality = \frac{FltNormalNum + TargetAdjNum + TargetDelNum}{FltTotalNumIni},$$

then:

$$TargetAdjNum = TargetNormality * FltTotalNumIni - TargetDelNum - FltNormalNum \quad (11); \text{ and}$$

step 3-4-3: calculating a total adjusted flight volume:

$$TargetTotalNum = TargetDelNum + TargetAdjNum \quad (12);$$

the step 4 comprises the following steps of:

step 4-1: defining variables;

step 4-2: setting parameters;

step 4-3: predicting an airspace flow based on a flight sequencing result; and step 4-4: generating an airspace network optimization solution;

the step 4-1 comprises: defining the following variables:

$AptCapMaxRatio_i$: an upper capacity increase limit of the airport $APT_i$ in a unit of %, wherein an initial value is 100%;

$AptAARMaxRatio_i$: an upper arrival capacity increase limit of the airport $APT_i$ in a unit of %, wherein an initial value is 100%;

$AptADRMaxRatio_i$: an upper departure capacity increase limit of the airport $APT_i$ in a unit of %, wherein an initial value is 100%;

$SectorCapMaxRatio_i$: an upper capacity increase limit of the sector $SECTOR_i$ in a unit of %, wherein an initial value is 100%;

$DealMark_i$: a processing status of the flight Fit, wherein 0 represents not participating in the processing, and 1 represents being already processed;

$SectorSimuFlow_{i,j}$: a number of flights entering the sector $SECTOR_i$ in the $j^{th}$ time slice according to the flight sequencing result, wherein an initial value is 0;

$DepSimuFlow_{i,j}$: a number of flights departing in the $j^{th}$ time slice of the airport $APT_i$ according to the flight sequencing result, wherein an initial value is 0;

$ArrSimuFlow_{i,j}$: a number of flights arrived in the $j^{th}$ time slice of the airport $APT_i$ according to the flight sequencing result, wherein an initial value is 0;

$tmpSectorSimuFlow_{i,j}$: a temporary variable of the number of flights entering the sector $SECTOR_i$ in the $j^{th}$ time slice, wherein an initial value is 0;

$tmpDepSimuFlow_{i,j}$: a temporary variable of the number of flights departing in the $j^{th}$ time slice of the airport $APT_i$ wherein an initial value is 0;

$tmpArrSimuFlow_{i,j}$: a temporary variable of the temporary variable of the number of flights arrived in the $j^{th}$ time slice of the airport $APT_i$, wherein an initial value is 0;

tmpDelCount: a temporary variable of the deleted flight volume, wherein an initial value is 0;

tmpAdjCount: a temporary variable of the time-adjusted flight volume, wherein an initial value is 0;

AspOptyList: an airspace network optimization solution, comprising a name, a type and a capacity increase value of an airspace needing to be optimized;

AspOptyListNum: a number of airspaces comprised in AspOptyList;

$AspOpty_i$: an $i^{th}$ airspace that needs to be optimized in:

$AspOpty_i(CODE)$: an airspace code of $AspOpty_i$;

$AspOpty_i(TYPE)$: an airspace type of $AspOpty_i$, wherein 0 represents the sector, and 1 represents the airport;

$AspOpty_i(Cap)$: a capacity increase value of $AspOpty_i$, wherein an initial value is 0;

$AspOpty_i(AAR)$: an arrival capacity increase value of $AspOpty_i$, which is only valid for airports, with an initial value of 0;

$AspOpty_i(ADR)$: a departure capacity increase value of $AspOpty_i$ which is only valid for airports, with an initial value of 0;

$MaxAspFlowVs_i$: a maximum value of a deviation between the flow and capacity of each time slice of an $i^{th}$ airspace object, wherein an initial value is 0;

$MaxDepFlowVs_i$: a maximum value of a deviation between the departure flights and departure capacity of each time slice of the $i^{th}$ airspace object, wherein an initial value is 0; and $MaxArrFlowVs_i$: a maximum value of a deviation between the arrival flights and arrival capacity of each time slice of the $i^{th}$ airspace object, wherein an initial value is 0;

the step 4-2 comprises:

step 4-2-1: limiting airport capacity increase carrying out the following settings for each airport $APT_i$ in the national airport array APTLIST:

limiting the airport capacity increase: letting $AptCapMaxRatio_i$=120%;

limiting the airport departure capacity increase: letting $AptADRMaxRatio_i$=120%; and limiting the airport arrival capacity increase: letting $AptAARMaxRatio_i$=120%;

step 4-2-2: limiting sector capacity increase:

carrying out the following settings for each sector $SECTOR_i$ in the national sector array SECTORLIST:

letting $SectorCapMaxRatio_i$=120%;

the step 4-3 comprises:

step 4-3-1: clearing a flight processing status:

for each flight $Flt_i$ in the national flight plan array FltListIni, letting $DealMark_i$=0;

step 4-3-2: filtering flights to be processed:

starting from a first flight in the array FltListIni, taking the first flight the $DealMark_i$ of which is currently 0, letting $DealMark_i$=1, and executing step 4-3-3; when all the flights are processed, completing the calculation in the step 4-3;

step 4-3-3: judging a sequenced adjustment mode of the flights:

when the sequenced adjustment mode of the flight $AdjMark_i$ is 3, it is indicated that the flight is suggested to be deleted and is not necessary to participate in flow statistics, returning to step 4-3-2; otherwise, executing step 4-3-4;

step 4-3-4: updating a flow of the departure airport of the flight:

setting the flight $Flt_i$ to departure in a $k^{th}$ time slice of a $j^{th}$ airport $APT_j$ in the array APTLIST according to the departure airport $DepApt_i$ and the sequenced time of departure $STD_i$ of the flight $Flt_i$ then letting $DepSimuFlow_{j,k}$=$DepSimuFlow_{j\ k}$+1;

step 4-3-5: updating a flow of the arrival airport of the flight:

setting the flight $Flt_i$ to arrive in the $k^{th}$ time slice of the $j^{th}$ airport $APT_j$ in the array APTLIST according to the arrival airport $ArrApt_i$ and the sequenced time of arrival $STA_i$ of the flight $Flt_i$, then letting $ArrSimuFlow_{j,k}$=$ArrSimuFlow_{j,k}$+1; and step 4-3-6: updating a flow of the sector passed by the flight:

setting the flight $Flt_i$ to enter a $j^{th}$ sector $SECTOR_j$ of the array SECTORLIST in the $k^{th}$ time slice according to the sector array $PassSectorList_i$ passed by the flight $Flt_i$ and the sequenced sector-entry time $PassSector_{i,j}$(InSTO) of each sector $PassSector_{i,j}$ in the array, and letting $SectorSimuFlow_{j,k}$=$SectorSimuFlow_{j,k}$+1; and then returning to step 4-3-2;

the step 4-4 comprises:

step 4-4-1: filtering the flights suggested to be deleted according to a capacity expansion limit, specifically comprising the following steps of:

step 4-4-1-1: clearing the flight processing status:

for each flight Fit, in the flight adjustment array FltList, letting the flight processing status be that $DealMark_i$=0; and letting tmpDelCount=0;

step 4-4-1-2: judging whether the filtering is finished:

when satisfying that tmpDelCount>=TargetDelNum, or all the flights in the array FltList are already processed, which means that $DealMark_i$ is 1, finishing the processing of the step 4-4-1; otherwise, continuing subsequent processing;

step 4-4-1-3: filtering flights to be processed:

starting from a first flight in the array FltList, taking the first flight $Flt_i$ the $DealMark_i$ of which is currently 0, letting $DealMark_i$=1, and developing subsequent operation;

step 4-4-1-4: judging a sequenced adjustment mode of the flight:

when the sequenced adjustment mode $AdjMark_i$ of the flight is not 3, it is indicated that the flight does not belong to the flights suggested to be deleted, returning to step 4-4-1-2; otherwise, continuing subsequent operation;

step 4-4-1-5: updating the flow of the departure airport of the flight:

setting the flight $Flt_i$ to departure in the $k^{th}$ time slice of the $j^{th}$ airport $APT_j$ in the array APTLIST according to the departure airport and the estimated time of departure $ETD_i$ of the flight $Flt_i$, then letting $tmpDepSimuFlow_{j,k}$=$DepSimuFlow_{j,k}$, and $tmpDepSimuFlow_{j,k}$=$tmpDepSimuFlow_{j,k}$+1;

step 4-4-1-6: judging whether the flow of the departure airport of the flight exceeds the capacity increase:

when satisfying that $tmpDepSimuFlow_{j,k}$>$AptADR_{j,k}$*$AptADRMaxRatio_j$, returning to step 4-4-1-2; and when satisfying that ($tmpDepSimuFlow_{j,k}$+$ArrSimuFlow_{j,k}$)>$AptCap_{j,k}$*$AptCapMaxRatio_j$, returning to step 4-4-1-2;

step 4-4-1-7: updating the flow of the arrival airport of the flight:

setting the flight $Flt_i$ to arrive in the $k^{th}$ time slice of the $j^{th}$ airport $APT_j$ in the array APTLIST according to the arrival airport and the estimated time of arrival $ETA_i$ of the flight $Flt_i$, then letting $tmpArrSimuFlow_{j,k}$=$ArrSimuFlow_{j,k}$, and $tmpArrSimuFlow_{j,k}$=$tmpArrSimuFlow_{j,k}$+1;

step 4-4-1-8: judging whether the flow of the arrival airport of the flight exceeds the capacity increase:

when satisfying that $tmpArrSimuFlow_{j,k}$>$AptAAR_{j,k}$*$AptAARMaxRatio_j$, returning to step 4-4-1-2; and when satisfying that ($tmpArrSimuFlow_{j,k}$+$DepSimuFlow_{j,k}$)>$AptCap_{j,k}$*$AptCapMaxRatio_j$, returning to step 4-4-1-2;

step 4-4-1-9: updating the flow of the sector passed by the flight:

setting the flight $Flt_i$ to enter the $j^{th}$ sector $SECTOR_j$ of the array SECTORLIST in the $k^{th}$ time slice according to the sector array $PassSectorList_i$ passed by the flight $Flt_i$ and the estimated sector-entry time $PassSector_{i,j}$(InETO) of each sector $PassSector_{i,j}$ in the array, then letting $tmpSectorSimuFlow_{j,k}$=$SectorSimuFlow_{j,k}$, and $tmpSectorSimuFlow_{j,k}$=$tmpSectorSimuFlow_{j,k}$+1;

step 4-4-1-10: judging whether the flow of the sector passed by the flight exceeds the capacity increase:

for any sector $SECTOR_j$ passed by the flight $Flt_i$, when $tmpSectorSimuFlow_{j,k}$>$SectorCap_{j,k}$*$SectorCapMaxRatio_j$ is satisfied when the flight $Flt_i$ enters the sector $SECTOR_j$ in the $k^{th}$ time slice, returning to step 4-4-1-2;

step 4-4-1-11: updating the selected deleted flight volume:

letting tmpDelCount=tmpDelCount+1;

for the departure airport of the flight $Flt_i$, setting that $DepSimuFlow_{j,k}$=$tmpDepSimuFlow_{j,k}$ for the airport;

for the arrival airport of the flight $Flt_i$, setting that $ArrSimuFlow_{j,k}$=$tmpArrSimuFlow_{j,k}$ for the airport; and for each sector $SECTOR_j$ passed by the flight $Flt_i$, letting $SectorSimuFlow_{j,k}=tmpSectorSimuFlow_{j,k}$; and returning to step 4-4-1-2;

step 4-4-2: filtering the flights suggested for time adjustment according to the capacity expansion limit, specifically comprising the following steps of:

step 4-4-2-1: clearing the flight processing status:

for each flight $Flt_i$ in the flight adjustment array FltList, letting the flight processing status be that $DealMark_i=0$; and letting tmpAdjCount=0;

step 4-4-2-2: judging whether the filtering is finished:

when satisfying that tmpAdjCount>=TargetAdjNum, or all the flights in the array FltList are already processed, which means that $DealMark_i$ is 1, finishing the processing of the step 4-4-2; otherwise, continuing subsequent processing;

step 4-4-2-3: filtering flights to be processed:

starting from the first flight in the array FltList, taking the first flight $Flt_i$ the $DealMark_i$ of which is currently 0, letting $DealMark_i=1$, and developing subsequent operation;

step 4-4-2-4: judging a sequenced adjustment mode of the flight:

when the sequenced adjustment mode $AdjMark_i$ of the flight is 3, it is indicated that the flight does not belong to the flights suggested for time adjustment, returning to step 4-4-2-2; otherwise, continuing subsequent operation;

step 4-4-2-5: updating a flow of the departure airport of the flight:

setting the flight $Flt_i$ to departure in the $k^{th}$ time slice of the $j^{th}$ airport $APT_j$ in the array APTLIST according to the departure airport and the estimated time of departure $ETD_i$ of the flight $Flt_i$, then letting $tmpDepSimuFlow_{j,k}=DepSimuFlow_{j,k}$, and $tmpDepSimuFlow_{j,k}=tmpDepSimuFlow_{j,k}+1$; and setting the flight $Flt_i$ to departure in an $m^{th}$ time slice of the $j^{th}$ airport $APT_j$ in the array APTLIST according to the departure airport and the sequenced time of departure $STD_i$ of the flight $Flt_i$, then letting $tmpDepSimuFlow_{j,m}=DepSimuFlow_{j,m}$, and $tmpDepSimuFlow_{j,m}=tmpDepSimuFlow_{j,m}-1$;

step 4-4-2-6: judging whether the flow of the departure airport exceeds the capacity increase:

when satisfying that $tmpDepSimuFlow_{j,k}>AptADR_{j,k}*AptADRMaxRatio_j$, returning to step 4-4-2-2; and when satisfying that $(tmpDepSimuFlow_{j,k}+ArrSimuFlow_{j,k})>AptCap_{j,k}*AptCapMaxRatio_j$, returning to step 4-4-2-2;

step 4-4-2-7: updating a flow of the arrival airport of the flight:

setting the flight $Flt_i$ to arrive in the $k^{th}$ time slice of the $j^{th}$ airport $APT_j$ in the array APTLIST according to the arrival airport and the estimated time of arrival $ETA_i$ of the flight $Flt_i$, then letting $tmpArrSimuFlow_{j,k}=ArrSimuFlow_{j,k}$, and $tmpArrSimuFlow_{j,k}=tmpArrSimuFlow_{j,k}+1$; and setting the flight $Flt_i$ to arrive in the $m^{th}$ time slice of the $j^{th}$ airport $APT_j$ in the array APTLIST according to the arrival airport and the sequenced time of arrival $STA_i$ of the flight $Flt_i$, then letting $tmpArrSimuFlow_{j,m}=ArrSimuFlow_{j,m}$, and $tmpArrSimuFlow_{j,m}=tmpArrSimuFlow_{j,m}-1$;

step 4-4-2-8: judging whether the flow of the arrival airport of the flight exceeds the capacity increase:

when satisfying that $tmpArrSimuFlow_{j,k}>AptAAR_{j,k}*AptAARMaxRatio_j$, returning to step 4-4-2-2; and when satisfying that $(tmpArrSimuFlow_{j,k}+DepSimuFlow_{j,k})>AptCap_{j,k}*AptCapMaxRatio_j$, returning to step 4-4-2-2;

step 4-4-2-9: updating the flow of the sector passed by the flight:

setting the flight $Flt_i$ to enter the $j^{th}$ sector $SECTOR_j$ of the array SECTORLIST in the $k^{th}$ time slice according to the sector array $PassSectorList_i$ passed by the flight $Flt_i$ and the estimated sector-entry time $PassSector_{i,j}$(In-ETO) of each sector $PassSector_{i,j}$ in the array, then letting $tmpSectorSimuFlow_{j,k}=SectorSimuFlow_{j,k}$, and $tmpSectorSimuFlow_{j,k}=tmpSectorSimuFlow_{j,k}+1$; and setting the flight $Flt_i$ to enter the $j^{th}$ sector $SECTOR_j$ of the array SECTORLIST in the $m^{th}$ time slice according to the sector array $PassSectorList_i$ passed by the flight $Flt_i$ and the sequenced sector-entry time $PassSector_{i,j}$(In-STO) of each sector $PassSector_{i,j}$ in the array, then, letting $tmpSectorSimuFlow_{j,m}=SectorSimuFlow_{j,m}$, and $tmpSectorSimuFlow_{j,m}=tmpSectorSimuFlow_{j,m}-1$;

step 4-4-2-10: judging whether the flow of the sector passed by the flight exceeds the capacity increase:

for any sector $SECTOR_j$ passed by the flight $Flt_i$, when $tmpSectorSimuFlow_{j,k}>SectorCap_{j,k}*SectorCapMaxRatio_j$ is satisfied when the flight $Flt_i$ enters the sector $SECTOR_j$ in the $k^{th}$ time slice, returning to step 4-4-2-2; and step 4-4-2-11: updating the selected time-adjusted flight volume:

letting tmpAdjCount=tmpAdjCount+1;

for the departure airport of the flight $Flt_i$, setting that $DepSimuFlow_{j,k}=tmpDepSimuFlow_{j,k}$ for the airport, and $DepSimuFlow_{j,m}=tmpDepSimuFlow_{j,m}$;

for the arrival airport of the flight $Flt_i$, setting that $ArrSimuFlow_{j,k}=tmpArrSimuFlow_{j,k}$ for the airport, and $ArrSimuFlow_{j,m}=tmpArrSimuFlow_{j,k}$; and for each sector $SECTOR_j$ passed by the flight $Flt_i$, letting $SectorSimuFlow_{j,k}=tmpSectorSimuFlow_{j,k}$, and $SectorSimuFlow_{j,m}=tmpSectorSimuFlow_{j,m}$; and returning to the step 4-4-2-2; and step 4-4-3: generating the airspace network optimization solution, specifically comprising the following steps of:

step 4-4-3-1: clearing the solution:

clearing the airspace network optimization solution AspOptyList, and letting AspOptyListNum=0;

step 4-4-3-2: counting airports needing to be optimized:

circularly carrying out the following processing for each airport $APT_i$ in the national airport array APTLIST:

step 4-4-3-2-1: calculating the deviation between the flow and capacity of each time slice:

calculating a deviation $(DepSimuFlow_{i,j}-AptADR_{i,j})$ between a departure flow and a departure capacity, a deviation $(ArrSimuFlow_{i,j}-AptAAR_{i,j})$ between an arrival flow and an arrival capacity, and a deviation $(DepSimuFlow_{i,j}+ArrSimuFlow_{i,j}-AptCap_{i,j})$ between a total flow and a total capacity of the airport $APT_i$ in each time slice J; and accordingly, calculating a maximum deviation $MaxDepFlowVs_i$ between the departure flow and the departure capacity, a maximum deviation $MaxArrFlowVs_i$ between the arrival flow and the arrival capacity, and a maximum deviation $MaxAspFlowVs_i$ between the total flow and the total capacity of the airport $APT_i$ in each time slice J;

when $MaxDepFlowVs_i<0$, letting $MaxDepFlowVs_i=0$;

when $MaxArrFlowVs_i<0$, letting $MaxArrFlowVs_i=0$; and when $MaxAspFlowVs_i<0$, letting $MaxAspFlowVs_i=0$;

step 4-4-3-2-2: filtering a capacity-expanded airport and calculating a capacity-expanded degree:

when the airport $APT_i$ satisfies that ($MaxDepFlowVs_i>0 \| MaxArrFlowVs_i>0 \| MaxAspFlowVs_i>0$), defining the airport as an airspace to be optimized $AspOpty_k$, and letting $AspOpty_k(CODE)=APT_i(CODE)$, $AspOpty_k(TYPE)=1$, $AspOpty_k(Cap)=MaxAspFlowVs_i$, $AspOpty_k(AAR)=MaxArrFlowVs_i$ and $AspOpty_k(ADR)=MaxDepFlowVs_i$; and adding $AspOpty_k$ to the airspace network optimization solution AspOptyList, and letting AspOptyListNum=AspOptyListNum+1;

step 4-4-3-3: counting sectors needing to be optimized:

circularly carrying out the following processing for each sector $SECTOR_i$ in the national sector array SECTORLIST:

step 4-4-3-3-1: calculating the deviation between the flow and capacity of each time slice:

calculating a deviation ($SectorSimuFlow_{i,j}-SectorCap_{i,j}$) between the flow and the capacity of the sector $SECTOR_i$ in each time slice j, and accordingly, counting a maximum deviation $MaxAspFlowVs_i$ between the flow and the capacity of the sector $SECTOR_i$ in each time slice; and when $MaxAspFlowVs_i<0$, letting $MaxAspFlowVs_i=0$; and step 4-4-3-3-2: filtering a capacity-expanded sector and calculating a capacity-expanded degree:

when the sector $SECTOR_j$ satisfies that $MaxAspFlowVs_i>0$, defining the sector $SECTOR_j$ as an airspace to be optimized $AspOpty_k$, and letting $AspOpty_k(CODE)=SECTOR_i(CODE)$, $AspOpty_k(TYPE)=0$, and $AspOpty_k(Cap)=MaxAspFlowVs_i$; and adding $AspOpty_k$ to the airspace network optimization solution, and letting AspOptyListNum=AspOptyListNum+1;

step 5: the flights are controlled by the airspace network optimization method for taking off and landing within the flight normality target, which avoids flight delays, reduces flying times of the flights and saves fuels of the flights.

* * * * *